US012195910B2

(12) United States Patent
Abrams et al.

(10) Patent No.: US 12,195,910 B2
(45) Date of Patent: Jan. 14, 2025

(54) MACHINEABLE AND COLLAPSIBLE LAUNDRY CONTAINER

(71) Applicant: Loop Laundry LLC, Richland, WA (US)

(72) Inventors: Jordan Benjamin Abrams, Beverly Hills, CA (US); Dawn Abrams Cryan, Richland, WA (US)

(73) Assignee: Loop Laundry, LLC, Richland, WA (US)

( * ) Notice: Subject to any disclaimer, the term of this patent is extended or adjusted under 35 U.S.C. 154(b) by 593 days.

(21) Appl. No.: 17/370,584

(22) Filed: Jul. 8, 2021

(65) Prior Publication Data

US 2022/0010482 A1 Jan. 13, 2022

Related U.S. Application Data

(60) Provisional application No. 62/705,629, filed on Jul. 8, 2020.

(51) Int. Cl.

| | |
|---|---|
| ***B65D 21/08*** | (2006.01) |
| ***A45C 7/00*** | (2006.01) |
| ***A45C 13/10*** | (2006.01) |
| ***D06F 39/02*** | (2006.01) |
| ***D06F 95/00*** | (2006.01) |

(52) U.S. Cl.

CPC ..... *D06F 95/002* (2013.01); *A45C 7/0077* (2013.01); *A45C 13/103* (2013.01); *B65D 21/086* (2013.01); *D06F 39/02* (2013.01); *D06F 95/008* (2013.01)

(58) Field of Classification Search

CPC ... B65D 21/086; A45C 13/103; A45C 7/0077; A45C 2003/002; D06F 95/006; D06F 95/008; D06F 39/02; D06F 95/002

USPC ..... 206/223

See application file for complete search history.

(56) References Cited

U.S. PATENT DOCUMENTS

| | | | | | |
|---|---|---|---|---|---|
| 4,974,967 | A * | 12/1990 | Tsuyoshi | D06F 95/006 | 383/102 |
| 4,989,995 | A * | 2/1991 | Rubenstein | D06F 95/006 | 383/102 |
| 5,746,514 | A * | 5/1998 | Orensten | D06F 95/006 | 383/88 |
| 7,334,941 | B2 * | 2/2008 | Fenster | D06F 95/006 | 383/105 |
| 8,640,506 | B1 * | 2/2014 | Grear | D06F 95/006 | 383/117 |
| 10,787,764 | B1 * | 9/2020 | Day | D06F 95/006 | |
| D943,275 | S * | 2/2022 | Davis | D3/287 | |
| 2004/0182117 | A1 * | 9/2004 | Fenster | D06F 95/006 | 68/235 R |

(Continued)

*Primary Examiner* — Ernesto A Grano

(74) *Attorney, Agent, or Firm* — Stephen S. Zimowski

(57) ABSTRACT

The present invention provides a laundry container that is uniquely operable as a standing hamper or tote when loading or holding dirty laundry and is sized and oriented to be closed and installed into a machine-washer and -dryer with the dirty laundry still within for cleaning without any user contact or interaction with the laundry articles themselves, the laundry container including features that allow it to be extended and stand upright for use as a loadable hamper or tote and to be collapsed, with or without laundry still inside, for purposes of transport or storage.

14 Claims, 16 Drawing Sheets

(56) References Cited

U.S. PATENT DOCUMENTS

2005/0129337 A1* 6/2005 Sabounjian ..... D06F 95/006 383/117
2005/0196075 A1* 9/2005 Heidel ..... D06F 95/006 383/117
2007/0253648 A1* 11/2007 Austin ..... B65F 1/1607 220/9.3
2008/0226204 A1* 9/2008 Sabounjian ..... D06F 95/006 383/117
2008/0250561 A1* 10/2008 Poston ..... A47C 31/105 5/499
2010/0018968 A1* 1/2010 Sabounjian ..... B65D 33/02 220/772
2011/0174811 A1* 7/2011 Sabounjian ..... D06F 95/002 220/9.2
2013/0092686 A1* 4/2013 Sabounjian ..... D06F 95/002 220/9.2
2013/0340159 A1* 12/2013 Barrett ..... A47K 3/325 4/599
2014/0353311 A1* 12/2014 Kellogg ..... B65D 37/00 383/117
2015/0053687 A1* 2/2015 Greenspon ..... B65D 21/086 220/490
2016/0167832 A1* 6/2016 Silverman ..... D06F 95/002 220/9.2
2016/0333515 A1* 11/2016 Eckerman ..... D06F 95/002
2017/0327997 A1* 11/2017 Florence ..... B65D 33/02
2019/0382947 A1* 12/2019 Doescher ..... B65D 33/28
2021/0316905 A1* 10/2021 Butterfield ..... B65D 33/1608
2022/0010480 A1* 1/2022 Allison ..... B31D 1/027
2022/0055797 A1* 2/2022 Liu ..... B65D 21/086
2022/0111083 A1* 4/2022 Johnson ..... A61L 2/10
2023/0160137 A1* 5/2023 Forgacs ..... D06F 95/004 232/1 B
2023/0304213 A1* 9/2023 Green Mullins ..... D06F 95/006

* cited by examiner

MACHINEABLE AND COLLAPSIBLE LAUNDRY CONTAINER

FIELD OF THE INVENTION

The invention relates to containers for holding laundry, and more specifically to a collapsible and expandable laundry container that can be loaded with dirty laundry, closed, inserted into a machine-washer for cleaning, transferred to a machine-dryer for drying, removed from the machines, opened, and emptied all without any user-contact or interaction with the laundry within.

BACKGROUND OF THE INVENTION

Laundry is a fact of life. Every day, millions of people around the world use laundry machines to wash and dry their dirty laundry. Many have machine-washers and -dryers at home, while others take their laundry to a public laundromat. Some estimate that 300 loads of laundry are machine laundered every year in each of the 128 million households in the United States alone. That's over 35 billion loads of laundry a year, many of which require transportation to and from a laundromat, or at the very least within one's own home.

In the era of Covid-19, awareness of sanitation practices has become more important than ever before to help prevent the spread of infectious diseases. Laundry practices, especially in public laundromats, are just one example of modern life that could use an upgrade in sanitation practices. Machines at public laundromats are shared by thousands of people over their lifetime, and laundry is commonly loaded directly into such laundry machines. Moreover, individuals must individually transfer each laundry item into a machine-washer, from a machine-washer to a machine-dryer, into a laundry basket, bag, or cart, and often onto a public surface for folding before taking the clean laundry home.

This process provides ample opportunity for laundry—even after having been cleaned—to contact numerous unsanitary surfaces. Add to this the possibility of a wayward sock or other article falling onto the floor or being otherwise misplaced or a stranger removing your laundry from a machine to make space for his or her own laundry, and it is clear that sanitation practices for doing laundry at public laundromats leave a lot to be desired.

And even for those that do laundry at home, the process requires loading dirty laundry into a hamper or other container, emptying the hamper either directly into a machine-washer or into a laundry basket for sorting and/or transfer to the laundry room, transferring each individual article from the machine-washer to the machine-dryer or other drying location, and then transferring everything from the machine-dryer either directly to a sorting/folding station or back into a laundry basket for transfer to a sorting/folding station. All this creates the same opportunities for items to be misplaced, dropped on the floor, or otherwise subjected to unsanitary conditions before being returned to a dresser, closet, or other storage location. And while the process may be less problematic for an individual or single family, it becomes far more inefficient and time consuming in more commercial applications, such as hotels, cruise ships, and other large-scale laundry applications.

There thus remains a need for a solution to these sanitation concerns that provides a clean, efficient way to transfer and clean laundry using laundry machines, a need for a laundry container that can hold dirty laundry until laundry day and be used to facilitate the machine cleaning and transport and folding processes. And there remains a need for a solution that can make the laundry process more clean and efficient in commercial and other large-scale applications.

SUMMARY OF THE INVENTION

It is accordingly an object of the present invention to provide a laundry container that operates as a hamper or tote that is capable of holding dirty laundry and can be placed directly within a machine-washer and -dryer, with the laundry therein, for cleaning. It is another object of the present invention to provide such a laundry container with means for opening the container for loading/unloading laundry and closing it during the transfer and cleaning processes. It still another object of the present invention to provide such a laundry container that is sized and oriented to fit in standard-sized machine-washers and -dryers and that is comprised of features and materials that allow it to employ a standing rigidity when desired, such as when in use as a hamper, and allow it to collapse when needed, such as when necessary to fit into a laundry machine or to save space.

The present invention is thus intended to operate like a dirty laundry hamper, tote, or other bag until it is time to machine-wash the laundry. The laundry container is sized and shaped to match the interior of the inner drum of machine-washers and -dryers such that it stores the laundry and then converts into a machine-able laundry container that can be added to a laundry machine, washed, and dried all with the dirty laundry securely held within. Then, once the cleaning process is complete and the laundry within is clean, the laundry container is easily removeable with all laundry items still inside and ready for transport home and/or to whatever sorting and folding location the user desires.

To accomplish these and other objectives, the present invention provides a laundry container with an upper end wall, a lower end wall, and a sidewall extending therebetween, in some preferable embodiments. Each is preferably made of a machine-washable and -dryable, flexible, mesh material, that permits the passage of fluids, such as soap and water, to help clean the contents of the laundry container. In some preferable embodiments, the materials forming the upper and lower end walls and sidewall are also anti-microbial, at least in part, and one or more may be made of a vinyl-coated, silicone, or other plastic material. The upper end wall is preferably moveably or rotateably affixed to the sidewall around at least a portion of its circumferential perimeter, and the lower end wall is likewise preferably affixed to the sidewall around its entire circumferential perimeter.

The upper and lower end walls are preferably circular in shape, although other shapes such as ovals, multilaterals, etc. are also possible. Each of the upper end wall and lower end wall is defined by a circumferential perimeter frame in preferable embodiments, which are preferably rigid or semi-rigid. In preferable embodiments employing circular upper and lower end walls, the sidewall is accordingly cylindrical in shape when extended. The upper end wall in circular embodiments has a diameter preferably between about 12 and 24 inches, more preferably between about 15 and 20 inches, and even more preferably around 16 inches. The lower end wall also has a diameter preferably between about 12 and 24 inches, more preferably between about 15 and 20 inches, and even more preferably around 17 inches. The sidewall's length when fully extended is preferably between about 6 and 24 inches, more preferably between about 10 and 15 inches, and even more preferably around 13 inches.

And when fully collapsed, the length is preferably less than about 4 inches, and more preferably around 2 inches or less.

Preferable embodiments of the laundry container also include one or more sidewall supports that operate to bias the sidewall outwardly and to maintain a standing rigidity of the laundry container such that it can stand upright without user assistance. This position, referred to as the upright position, makes loading the laundry container with dirty laundry easier as well as ensuring that the laundry container stays fully extended when inserted into a machine-washer and -dryer, helping to ensure an effective cleaning process for the laundry located inside.

The supports preferably also operate to permit the container to collapse substantially flat, referred to herein as the collapsed state, in which the sidewall loses its standing rigidity and the upper and lower end walls move substantially adjacent to one another. In preferable embodiments in which the circumferential perimeter frames of the upper and lower end walls are rigid or semi-rigid, the container maintains its (top-down) shape in the collapsed state. Some embodiments of the upper/lower end walls' circumferential perimeter frames may be non-rigid such that the end walls can be folded or otherwise collapsed as well. The collapsed state may be preferable for the cleaning process in some circumstances, if there is an issue with fitting the container within a machine-washer or -dryer for some reason, or may be preferable during transport of the container with or without laundry within or for storing the container away when not in use.

In some preferable embodiments, the one or more supports providing the sidewall with a standing rigidity may include one or more sidewall stiffening panes and one or more associated stiffening pane pockets. The stiffening panes are preferably rotateably attached to the upper end wall's circumferential perimeter frame, with the associated stiffening pane pockets preferably arranged adjacent to the lower end wall's circumferential perimeter frame. As such, the lower ends of the stiffening panes may be inserted into the stiffening pane pockets to provide the sidewall with a standing rigidity when the container is in the upright position and may be removed from the stiffening pane pockets to allow the container to collapse into the collapsed state. Notably, and as will be understood by those of skill in the art, this particular arrangement of the stiffening panes and stiffening pane pockets is just one such alternative arrangement, and the sidewall supports in such embodiments may operate just as effectively with other arrangements, such as the stiffening pane pockets located adjacent to the upper end wall and the stiffening panes rotateably attached to the lower end wall's circumferential perimeter frame as just one example.

In some preferable embodiments, the one or more sidewall supports may also or alternatively include one or more stiffening spiral ribs extending between the upper and lower end walls' circumferential perimeter frames and arranged around the perimeter of the sidewall. Such stiffening spiral ribs likewise operate to provide the sidewall with a standing rigidity but permit the sidewall to collapse when subjected to a compressing force from above and/or below. In such preferable embodiments, the stiffening spiral ribs preferably naturally return the container to the upright position upon removal of the compressing force, so means for retaining the container in the collapsed state are preferably included as well.

Preferable embodiments of the laundry container also include fastening means engageable to fully connect the upper end wall with the sidewall. Such fastening means facilitate keeping the top of the laundry container open when necessary for the loading and unloading process and closing the top in a substantially sealed manner such that clothing items do not inadvertently fall out of the container during transport to and from a machine-washer or -dryer and/or from home to a laundromat, etc.

The fastening means may include for example, a zip fastener with a first row of teeth extending around a substantial portion of the circumferential perimeter of the upper end wall, a second row of teeth extending around a substantial portion of the circumferential perimeter of an upper end of the sidewall adjacent to the upper end wall, and a slider that operates to engage and disengage the first and second rows of teeth. The first and second rows of teeth may alternatively extend along a relatively central diameter of the upper end wall such that the container's top opens and closes from the center rather than from an edge. Those of skill in the art will recognize various alternative fastening means, such as hook-and-loop, snap, and magnet fasteners and the like, all of which may be used without altering the present invention's operation.

In embodiments that employ the zip fastener, the slider may be used to disengage the upper end wall from the sidewall to open the top and permit access to the interior of the laundry container to load laundry items, which is referred to herein as the open state. The slider is likewise operable to engage the upper end wall and the sidewall to fully close the container's top and prevent clothing items from being added or removed, referred to herein as the closed state. In some preferable embodiments, the fastening means may also include a slider shroud that is located and oriented to substantially encompass the slider to prevent damage to the interior of a machine-washer or -dryer during the cleaning process.

The laundry container of the present invention thus operates as a standing hamper when in the upright position, loadable and unloadable when the top is open. The laundry container is sized and shaped to fit within standard-sized machine-washers and -dryers when in the upright position such that a user can close the top and insert it directly into a laundry machine with the laundry already within and ready for cleaning. Furthermore, the laundry container may be collapsed into the collapsed state, with or without laundry therein, to assist in transport, storage, or fitting into a laundry machine with other items already inside.

Preferable embodiments of the laundry container of the present invention also include one or more transport handles, one or more carrying straps, and one or more loading handles. The one or more transport handles facilitate transporting the container over short distances, from washer to dryer, for example. The one or more carrying straps may be arranged substantially parallel to the length of the sidewall, substantially perpendicular to the length of the sidewall, or at any angle therebetween, and each of the above arrangements may be used simultaneously in some embodiments. The carrying straps facilitate transporting the container over longer distances, such as to and from the laundromat, and may facilitate carrying the container like a backpack or duffel bag, in some preferable embodiments. The one or more loading handles are preferably provided on the outer surface of the upper and/or lower end walls and facilitate easy insertion and removal of the laundry container into and from machine-washers and -dryers.

Some preferable embodiments of the present invention include one or more magnets positioned among one or more of the upper and lower end walls and sidewall, operating to attach the laundry container to the inner drum of a machine-washer and -dryer. The magnets help to ensure that the container gets agitated along with the inner drum, assisting the cleaning of laundry contained therein. Some preferable embodiments include one or more detergent pockets as well, which are preferably located in easy to reach positions to allow a user to add a detergent pod and/or other cleaning materials either before or after insertion of the laundry container into a machine-washer. Such detergent pockets are preferably made of a machine-washable and -dryable, flexible, mesh material such that water, soap, and other fluids may freely pass into and out of the detergent pockets.

Preferable embodiments of the laundry container according to the present invention also include a central bore sized and oriented to accommodate the vertical protrusion present in the central interior of some machine-washers. The central bore is preferably made of the same machine-washable and -dryable, flexible, mesh material that permits fluids to pass freely and is preferably extendable from one of the upper or lower end walls into the interior of the laundry container when needed to accommodate the vertical protrusion and otherwise collapsible to avoid interfering with the laundry contained within during the loading and/or cleaning processes when not needed. Some preferable embodiments with a central bore also include a bore pouch for stowing the central bore when it is not needed, the bore pouch preferably including fastening means, such as a zip fastener, for closing and retaining the central bore therein.

To further accomplish the objectives of the present invention, a tote-style laundry container including a rigid or semi-rigid lower panel and a collapsible upper bag portion is provided in some preferable embodiments. The lower panel and upper bag portion are preferably made of a machine-washable and -dryable, flexible, mesh material that allows fluids, such as water, soap, detergent, etc. to freely pass therethrough. In some preferable embodiments, the lower panel and upper bag portion are made up of antimicrobial materials, at least in part. The lower panel may be affixed to the upper bag portion around its entire circumferential perimeter or around only a portion of its circumferential perimeter, in some embodiments, making the lower panel moveably and/or rotateably affixed to the upper bag portion.

The lower panel is preferably circular in shape, although other multilateral or rounded shapes are possible as well. The shape of the lower panel is defined by its circumferential perimeter frame, which is rigid or semi-rigid in some preferable embodiments. In circular embodiments, the lower panel has a diameter preferably between about 12 and 24 inches, more preferably between about 15 and 20 inches, and even more preferably of around 18.5 inches. The upper bag portion has a fully-extended length preferably between about 12 and 24 inches, more preferably between about 15 and 20 inches, and even more preferably of around 18 inches. And when collapsed, the length is preferable less than about 4 inches, and more preferably around 2.5 inches or less.

Preferable embodiments of the tote-style laundry container may also include one or more sidewall supports that operate to bias the collapsible upper bag portion outwardly and to maintain a standing rigidity of the tote-style container such that it can stand upright without user assistance. Loading the tote-style container with dirty laundry is made easier when it is in the upright position, and the sidewall supports help ensure that the tote-style container stays fully extended when in use in machine-washers and -dryers, facilitating an effective cleaning process for the laundry located inside.

The supports preferably also operate to permit the container to collapse into the substantially flat, collapsed state, in which the tote-style container loses its standing rigidity and the upper bag portion collapses down to lie substantially adjacent to the lower panel. In preferable embodiments in which the circumferential perimeter frame of the lower panel is rigid or semi-rigid, the lower panel maintains its (top-down) shape while the collapsible upper bag portion collapses thereupon. Some embodiments of the lower panel's circumferential perimeter frame may be non-rigid such that the lower panel can be folded or otherwise collapsed as well. The collapsed state may be preferable for the cleaning process in some circumstances, if there is an issue with fitting the tote-style container within a machine-washer or -dryer for some reason, or may be preferable during transport of the container with or without laundry within or for storing the container away when not in use.

In some preferable embodiments, the one or more supports providing the tote-style container with a standing rigidity may include one or more sidewall stiffening panes and one or more associated stiffening pane pockets. The stiffening panes are preferably rotateably attached to one or more substantially linear ribs located at or near the upper periphery of the upper bag portion, with the associated stiffening pane pockets preferably arranged adjacent to the lower panel's circumferential perimeter frame, though the opposite arrangement is likewise effective. The lower ends of the stiffening panes may thus be inserted into the stiffening pane pockets to provide the upper bag portion with a standing rigidity when the tote-style container is in the upright position and may be removed from the stiffening pane pockets to allow the container to collapse into the collapsed state.

In some preferable embodiments, the one or more sidewall supports may also or alternatively include one or more stiffening spiral ribs extending up from the lower panel's circumferential perimeter frame and arranged around the perimeter of the upper bag portion. Such stiffening spiral ribs likewise operate to provide the upper bag portion with a standing rigidity but permit the upper bag portion to collapse when subjected to a compressing force. In such preferable embodiments, the stiffening spiral ribs preferably naturally return the tote-style container to the upright position upon removal of the compressing force, so means for retaining the container in the collapsed state are preferably included as well.

In preferable embodiments of the tote-style container in which the lower panel is moveably and/or rotateably affixed to the upper bag portion, fastening means engageable to fully connect the lower panel with the upper bag portion are also preferably provided. Alternatively, fastening means may be provided to engage the one or more upper ribs of the upper bag portion. Such fastening means facilitate opening and closing the tote-style container for loading and unloading laundry and ensuring laundry items do not come out of the tote-style container inadvertently during cleaning and/or transportation. In preferable embodiments employing fastening means on the one or more upper ribs of the upper bag portion, the upper ribs preferably extend to a substantially linear length of between about 18 and 36 inches, more preferably of between about 25 and 30 inches, and even more preferably of around 28 inches.

The fastening means may include, in preferable embodiments, a zip fastener with a first row of teeth extending along a substantial portion of a first upper rib of the upper bag portion, a second row of teeth extending along a substantial portion of a second upper rib of the upper bag portion, and a slider the operates to engage and disengage the first and second rows of teeth. The first row of teeth may alternatively extend around a substantial portion of the circumferential perimeter frame of the lower panel and the second row of teeth may extend around the lower end of the upper bag portion adjacent to the lower panel, in which case the tote-style container may be opened and closed by engaging and disengaging the lower panel from the upper bag portion. Those of skill in the art will recognize various alternative fastening means, such as hook-and-loop, snap, and magnet fasteners and the like. In some preferable embodiments, the fastening means may also include a slider shroud that is located and oriented to substantially encompass the slider to prevent damage to the interior of a machine-washer or -dryer during the cleaning process.

The tote-style container of the present invention thus operates as a standing laundry bag when in the upright position and is loadable and unloadable when opened. The tote-style container is also sized and shaped to fit within standard-sized machine-washers and -dryers when in the upright position such that a user can close and insert it directly into a laundry machine with the laundry already within and ready for cleaning. Furthermore, the tote-style container may be collapsed into the collapsed state, with or without laundry therein, to assist in transport, storage, or adding to a laundry machine.

Preferable embodiments of the tote-style container also include one or more transport handles and one or more loading handles. The one or more transport handles facilitate transporting the container, and the one or more loading handles may be provided on the outer surface of the lower panel to facilitate insertion and removal of the tote-style container into and from machine-washers and -dryers.

Some preferable embodiments of the tote-style container may also include one or more carrying straps. The one or more carrying straps may be arranged substantially parallel to the length of the upper bag portion, substantially perpendicular to the length of the upper bag portion, at any angle therebetween, or any combination thereof. The carrying straps can help with transporting the tote-style container over longer distances, such as to and from the laundromat, and may facilitate carrying the tote-style container like a backpack or duffel bag, in some preferable embodiments.

Some preferable embodiments of the tote-style container may include one or more magnets positioned among one or both of the upper bag portion and lower panel, operating to attach the tote-style container to the inner drum of a machine-washer and -dryer. The magnets help to ensure that the container gets agitated along with the inner drum, assisting the cleaning of laundry contained therein. Some preferable embodiments include one or more detergent pockets as well, which are preferably located in easy to reach positions to allow a user to add a detergent pouch or other cleaning materials either before or after insertion of the laundry container into a machine-washer. Such detergent pockets are preferably made of a machineable, flexible, mesh material such that water, soap, and other fluids may freely pass into and out of the detergent pockets.

Some preferable embodiments of the tote-style container of the present invention include a central bore sized and oriented to accommodate the vertical protrusion in the inner drum of some machine-washers. The central bore is preferably made of the same machineable, flexible, mesh material that permits fluids to pass freely and is preferably extendable from the lower panel into the interior of the tote-style container when needed to accommodate the vertical protrusion and otherwise collapsible to avoid interfering with the laundry contained within during the loading, cleaning, and unloading processes when not needed. Some preferable embodiments with a central bore also include a bore pouch for stowing the central bore when it is not needed, the bore pouch preferably including fastening means, such as a zip fastener, for closing and retaining the central bore therein.

To further accomplish the objectives of the present invention, a laundry container including an upper end wall, a lower end wall, and a semi-rigid sidewall is provided in some preferable embodiments. Each is preferably made of a machine-washable and -dryable, silicon, mesh material that permits the free flow of fluids, such as soap and water, to help clean the contents of the laundry container, and is preferably anti-microbial, at least in part.

The semi-rigid sidewall is extendable to maintain an upright position of the container and collapsible to maintain a collapsed state. To extend the container from the collapsed state into the upright position, a user pulls the upper end wall away from the lower end wall, creating an opposing and extending force substantially parallel to the semi-rigid sidewall's length that extends the semi-rigid sidewall into the upright position. To collapse the container from the upright position into the collapsed state, the user applies a compressing force, also substantially parallel to the semi-rigid sidewall's length, to one or both of the upper and lower end walls, causing the semi-rigid sidewall to compress into the collapsed state. Because of the unique makeup and design of the semi-rigid sidewall, the laundry container will remain in whatever state a user puts it in until it is again acted upon by a compressing or extending force.

The upper and lower end walls are preferably circular in shape, although other shapes such as ovals, multilaterals, etc. are also possible. The upper lower end walls may be defined by a circumferential perimeter frame in some embodiments, which are preferably rigid or semi-rigid. In preferable embodiments employing circular upper and lower end walls, the sidewall is accordingly cylindrical in shape. The upper end wall in circular embodiments has a diameter preferably between about 18 and 36 inches, more preferably between about 25 and 30 inches, and even more preferably around 27 inches. The lower end wall has a diameter preferably between about 12 and 24 inches, more preferably between about 15 and 20 inches, and even more preferably around 18 inches. The sidewall's length when fully extended is preferably between about 12 and 30 inches, more preferably between about 20 and 25 inches, and even more preferably around 24 inches. And when fully collapsed, the length is preferably less than about 5 inches, and more preferably around 3 inches or less.

Preferable embodiments of the laundry container also include fastening means engageable to fully connect the upper end wall with the sidewall. Such fastening means facilitate keeping the top of the laundry container open when necessary for the loading and unloading process and closing the top so that clothing items do not inadvertently fall out of the container during cleaning or transport.

The fastening means may include a zip fastener with a first row of teeth extending around a substantial portion of the circumferential perimeter of the upper end wall, a second row of teeth extending around a substantial portion of the circumferential perimeter of an upper end of the sidewall adjacent to the upper end wall, and a slider that operates to engage and disengage the first and second rows of teeth. The first and second rows of teeth may alternatively extend along a relatively central diameter of the upper end wall such that the container's top opens and closes from the center rather than from an edge. In some preferable embodiments, the fastening means may also include a slider shroud that is located and oriented to substantially encompass the slider to prevent damage to the interior of a machine-washer or -dryer during the cleaning process.

The laundry container of the present invention thus operates as a standing hamper when in the upright position, loadable and unloadable when the top is open, and is sized and shaped to fit within standard-sized machine-washers and -dryers when in the upright position such that a user can close the top and insert it directly into a laundry machine with the laundry already within and ready for cleaning. The laundry container may also be collapsed into the collapsed state, with or without laundry therein, to assist in transport, storage, etc.

Preferable embodiments of the laundry container of the present invention also include one or more transport handles, one or more carrying straps, and one or more loading handles. Some preferable embodiments of the present invention include one or more magnets positioned among one or more of the upper and lower end walls and sidewall, operating to attach the laundry container to the inner drum of a machine-washer and -dryer. And some preferable embodiments include one or more detergent pockets as well, which the user may load with cleaning materials.

Preferable embodiments of the laundry container according to the present invention may also include a central bore sized and oriented to accommodate the vertical protrusion present in the central interior of some machine-washers. The central bore is preferably collapsible and extendable from one of the upper or lower end walls into the interior of the container. Some preferable embodiments with a central bore also include a bore pouch for stowing the central bore when it is not needed, the bore pouch preferably including fastening means, such as a zip fastener, for closing and retaining the central bore therein.

As those skilled in the art will appreciate, the present invention is not limited to the embodiments and arrangements described above. Other objects of the present invention and its particular features and advantages will become more apparent from consideration of the following drawings and detailed description of the invention.

DETAILED DESCRIPTION OF THE INVENTION

The following detailed description illustrates the invention by way of example, not by way of limitation of the principles of the invention. This description will enable one skilled in the art to make and use the invention and describes several embodiments, adaptations, variations, alternatives, and uses of the invention, including what is presently believed to be the best mode of carrying out the invention. Those skilled in the art will recognize alternative variations and arrangements, and the present technology is not limited to those embodiments described hereafter.

Figure 1:
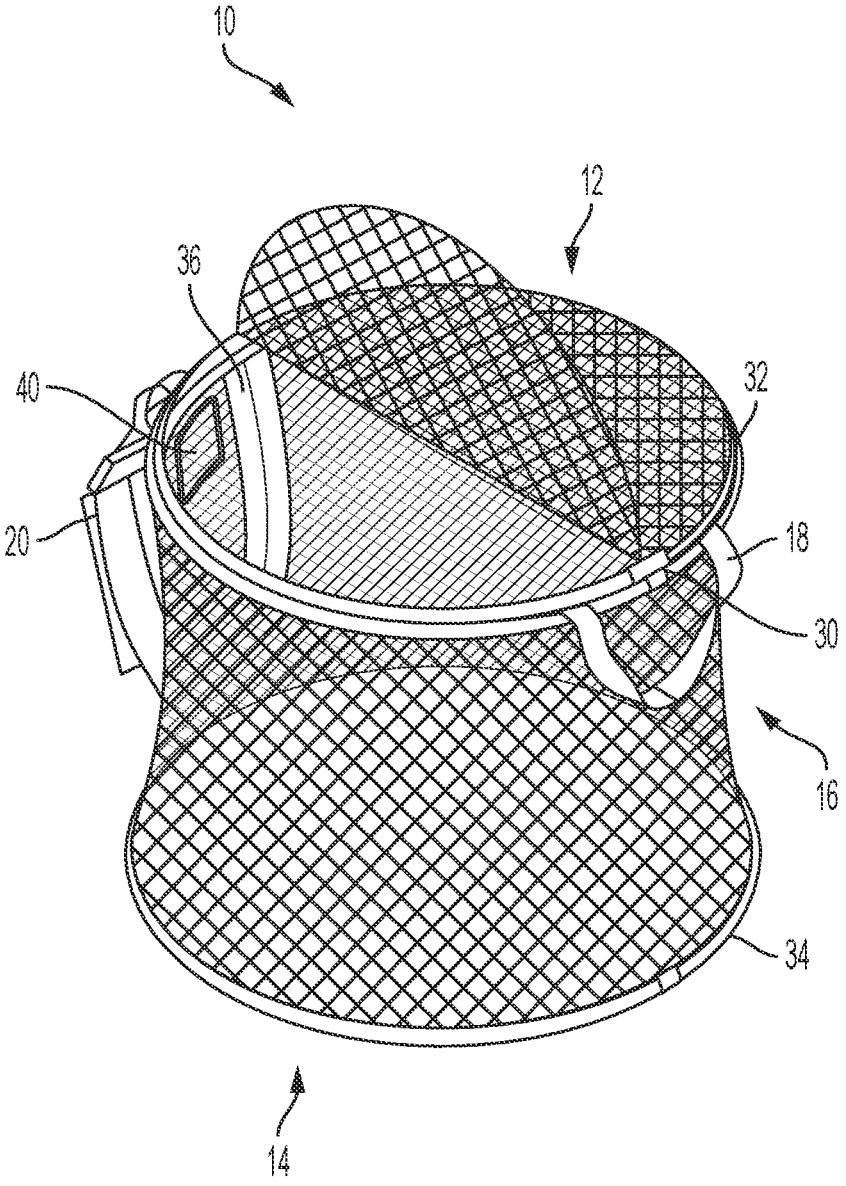
FIG. 1 depicts an isometric view of a laundry container in the upright position with the top open according to exemplary embodiments of the present invention.

Referring first to FIG. 1, a preferable embodiment of a laundry container 10 according to the principles of the present invention is depicted. The laundry container 10 includes an upper end wall 12, a lower end wall 14 and a sidewall 16 extending therebetween. The sidewall 16 preferably connects to circumferential perimeter frames 32, 34 of the upper and lower end walls 12, 14. In some preferable embodiments, the sidewall 16 may also include upper and lower circumferential frames of its own adjacent to the circumferential perimeter frames 32, 34 of the upper and lower end walls 12, 14, respectively, and the sidewall's 16 upper and lower circumferential frames may be used to attach the sidewall 16 to the circumferential perimeter frames 32, 34 of the upper and lower end walls 12, 14.

The circumferential perimeter frames 32, 34 are preferably rigid or semi-rigid to provide the laundry container 10 with a shape defining frame, although other manners of defining the laundry container's 10 shape will be apparent to those of skill in the art. The upper and lower end walls 12, 14, and sidewall 16 are preferably made up of a machine-washable and -dryable, flexible, mesh material that permits the free passage of fluids, including water, soap, laundry detergent, etc. therethrough. The materials making up these features of the laundry container 10 are also preferably anti-microbial, at least in part, to facilitate the cleaning process and ensure maximum elimination of bacteria, viruses, infectious diseases, etc.

The laundry container 10 according to preferable embodiments of the present invention also preferably includes a support structure including one or more supportive features that operate to provide the laundry container 10 with a standing rigidity and retain it in an upright position while also allowing the laundry container 10 to be condensed into a collapsed state. In some preferable embodiments, the circumferential perimeter frames 32, 34 of the upper and lower end walls 12, 14 and those of the sidewall 16 may be part-in-parcel to the support structure.

In preferable embodiments, these supportive features include one or more sidewall stiffening panes 36 and one or more associated stiffening pane pockets 38. The stiffening panes 36 operate to bias the sidewall 16 outwardly and to maintain a constant distance between the circumferential perimeter frames 32, 34 of the upper and lower end walls 12, 14, providing the sidewall 16 with a standing rigidity and retaining the laundry container 10 in the upright position.

In preferable embodiments, a proximal end of each stiffening pane 36 is preferably rotateably attached to the circumferential perimeter frame 32 of the upper end wall 12, and a distal end of each stiffening pane 36 is capable of insertion into its associated stiffening pane pocket 38, located adjacent to and/or affixed to the circumferential perimeter frame 34 of the lower end wall 14. As those of skill in the art will recognize, the opposite arrangement is equally effective, in which the proximal end of each stiffening pane 36 is rotateably attached to the lower end wall's 14 circumferential perimeter frame 34 and the associated stiffening pane pocket 38 is located adjacent to and/or affixed to the circumferential perimeter frame 32 of the lower end wall 12.

The stiffening panes 36 are preferably made of a rigid or semi-rigid, polymer or elastomer, such as plastic, and are preferably capable of deforming in response to compressing forces and springing back to form once the compressing forces are released. Accordingly, preferable embodiments of the laundry container 10 employing stiffening panes 36 are retained in the upright position so long as the distal ends of the stiffening panes 36 are inserted into their associated stiffening pane pockets 38, maintaining the standing rigidity of sidewall 16. If a compressive force is applied from above or below, the preferable embodiments of the stiffening panes 36 will deform to permit the circumferential perimeter frame 32 of the upper end wall 12 to reach or nearly reach the circumferential perimeter frame 34 of the lower end wall 14, placing the laundry container 10 in the collapsed state. In such embodiments, the laundry container 10 will naturally spring back into the upright position upon release of the compressive force, so some preferable embodiments include fastening means to retain the laundry container 10 in the collapsed state, such as a hook-and-loop fastener, snaps, or the like, as will be understood to those of skill in the art.

When the stiffening panes 36 are released from the associated stiffening pane pockets 38, the sidewall 16 loses its standing rigidity, in some preferable embodiments, and the laundry container 10 will naturally collapse into the collapsed state. This functionality allows the laundry container 10 to operate as a standing hamper in the upright position, available to load laundry or to be inserted into a machine-washer or -dryer for cleaning, and to collapse into the more compact collapsed state for storage or transport, notably with or without first removing laundry items therein.

Some preferable embodiments of the support structure include, in addition to the stiffening panes 36 and associated stiffening pane pockets 38 or as an alternative thereto, one or more stiffening spiral ribs extending along the sidewall 16 between its upper and lower circumferential frames, in some embodiments, or between the circumferential perimeter frame 32 of the upper end wall 12 and the circumferential perimeter frame 34 of the lower end wall 14, in others. Like the sidewall stiffening panes 36, the stiffening spiral ribs are preferably made of a rigid or semi-rigid, polymer or elastomer and are preferably capable of deforming and springing back to form upon release of any applied compressing forces. The stiffening spiral ribs likewise operate to bias the sidewall 16 outwardly and provide it with a standing rigidity, either alone or in combination with other supportive features of the support structure of laundry container 10.

Preferable embodiments of the upper and lower end walls 12, 14 have a circular cross-sectional shape, when viewed from above, and the sidewall 16 is accordingly cylindrical in shape, when fully extended in the upright position, as depicted in FIG. 1. However, as those of skill in the art will recognize, other circular or multilateral shapes are likewise available, such as an oval, rectangle, etc., and the present invention is not limited to any specific shape or arrangement. The objective is to provide a laundry container 10 that is sized and shaped to fit into standard-sized machine-washers and -dryers, whether in the upright position, the collapsed state, or anywhere in between.

In preferable embodiments with circular upper and lower end walls 12, 14 and a cylindrical sidewall 16, such as that depicted in FIG. 1, the upper end wall 12 has a diameter preferably between about 12 and 24 inches, more preferably between about 15 and 20 inches, and even more preferably around 16 inches. And the lower end wall 14 also has a diameter preferably between about 12 and 24 inches, more preferably between about 15 and 20 inches, and even more preferably around 17 inches. When the laundry container 10 is in the upright position and the sidewall 16 is fully extended, the sidewall's 16 length is preferably between about 6 and 18 inches, more preferably between about 10 and 15 inches, and even more preferably around 13 inches. When fully collapsed, the sidewall's 16 length is preferably less than about 3 inches, and more preferably around 2 inches or less. While these sizes are preferable, those of skill in the art will recognize they are not precisely necessary to accomplish the objectives of the present invention.

Preferable embodiments of the present invention also include fastening means 22 for opening and closing the top of the laundry container 10 for loading and unloading laundry. The fastening means 22 preferably include a zip fastener, but may alternatively or additionally include one or more of hook-and-loop fasteners, snap fasteners, magnet fasteners, or the like, as will be recognized by those of skill in the art. Preferable embodiments that use a zip fastener, including that depicted in FIG. 1, include a first row of teeth 24 affixed around a substantial portion of the circumferential perimeter of the upper end wall 12, preferable affixed to the circumferential perimeter frame 32 of the upper end wall 12, a second row of teeth 26 affixed around a substantial portion of a substantial periphery of the edge of the sidewall 16 adjacent to the upper end wall 12, preferably affixed to the sidewall's 16 upper circumferential frame, and a slider 28 for engaging and disengaging the first and second rows of teeth 24, 26. Alternatively, the first and second rows of teeth 24, 26 may be provided across a central diameter of the upper end wall 12, such that the slider 28 operates to open and close the top of the laundry container 10 from the center of the upper end wall 12.

As depicted in FIG. 1, the laundry container 10 includes a slider shroud 30 to cover the slider 28 in preferable embodiments that use a zip fastener. The slider shroud 30 encompasses the slider 28 to avoid scratching or other damage to the inner drum of machine-washers and -dryers when the laundry container is inserted therein for cleaning. The slider shroud 30 is located and arranged such that it can substantially encompass the slider 28 once the slider 28 has engaged the first and second rows of teeth 24, 26 and the top of the laundry container 10 is closed.

Preferable embodiments of the laundry container 10 include one or more carrying straps 20, which may be oriented parallel or perpendicular to the length of the sidewall 16 or at any angle therebetween, or a combination of such arrangements. In some preferable embodiments, at least two carrying straps 20 are provided substantially parallel to one another and substantially perpendicular to the length of the sidewall 16, facilitating transporting the laundry container 10 similar to a backpack. In some preferable embodiments, at least one carrying strap 20 is provided substantially parallel to length of the sidewall 16, facilitating transporting the laundry container 10 similar to a duffel bag. Some preferable embodiments also include one or more transport handles 18. The transport handles 18 may be preferable for transporting the laundry container 10 over short distances, such as to and from an in-home machine-washer and -dryer, while the carrying straps 20 may be preferable for transporting the laundry container over longer distances, such as to and from a public laundromat.

Some preferable embodiments also include one or more loading handles 42 to assist in loading/unloading the laundry container 10 from the laundry machines and in unloading clean laundry from within. The loading handles 42 are preferably affixed to the outer surface of the upper end wall 12, the lower end wall 14, or both. The loading handles 42 should be easily accessible to a user seeking to remove the laundry container 10 from a laundry machine. At least one loading handle 42 is preferably located on the bottom surface of the lower end wall for use in flipping the laundry container 10 over and dumping out the laundry items therein.

Some preferable embodiments of the laundry container include one or more detergent pockets 40. The detergent pockets 40 are preferably made of the same flexible mesh material as that of the sidewall 16, and may preferably be capable of holding solids or powders while allowing fluids to pass through. At least one of the detergent pockets 40 is preferably located to be conveniently accessible even after the laundry container 10 has been inserted into a machine-washer. The detergent pockets 40 are provided to add laundry detergent, detergent pods, or other cleaning products for use in a machine-washer cleaning cycle.

Some preferable embodiments of the laundry container 10 also include one or more magnets arranged and distributed among one or more of the upper and lower end walls 12, 14 and sidewall 16. The magnets operate to attach the laundry container 10 to the inner drum of a machine-washer and -dryer to ensure the laundry container is sufficiently agitated along with the machines' inner drums to facilitate the cleaning process. The magnets also help to ensure the launder container 10 does not get "balled up" during the cleaning or drying cycles, which could negatively impact the effectiveness on the laundry items contained therein. In some preferable embodiments, a coin pouch or other feature capable of holding coins, keys, detergent pods, dryer sheets, a laundry card, and other items may be provided as well. The coin pouch is helpful for those using laundry container 10 at a public laundromat.

Preferable embodiments of the laundry container 10 also include a central bore designed and oriented to accommodate the vertical protrusion present in the center of the inner drum of some machine-washers. The central bore is preferably provided in the upper end wall 12 or the lower end wall 14 and is preferably made up of the same machine-washable and -dryable, flexible, mesh material as the other features of laundry container 10.

The central bore preferably operates to extend down from the upper end wall 12 or up from the lower end wall 14 and into the interior of the laundry container 10. When inserted into a machine-washer with a vertical protrusion, the central bore expands over the vertical protrusion, moving laundry items within the laundry container 10 towards the sidewall 16 to make room for the vertical protrusion. Upon removing the laundry container 10 from the machine-washer with a vertical protrusion, the central bore is no longer needed and may be rolled up, collapsed, or otherwise stowed away to avoid interference with loading the laundry container with dirty laundry, etc. Some preferable embodiments include a bore pouch to store the central bore when it is not needed, and some such embodiments include fastening means to ensure the central bore does not inadvertently escape from the bore pouch.

Figure 2B:
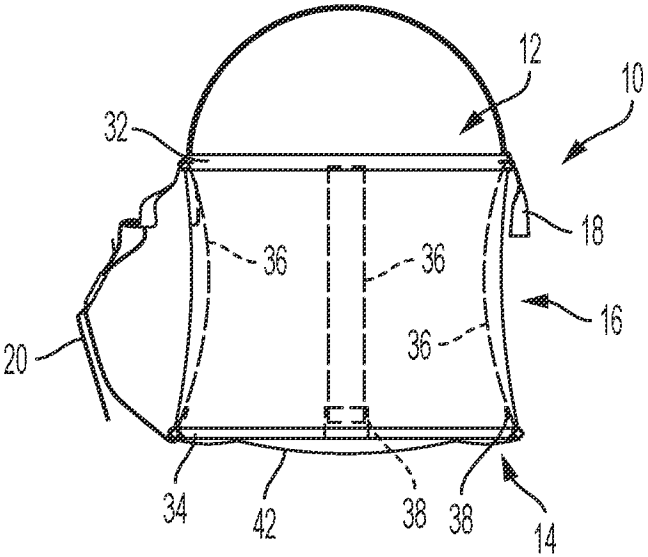
FIG. 2B depicts an orthogonal view from a side of a laundry container in the upright position with the top open according to the exemplary embodiments of the present invention depicted in FIGS. 1 and 2A.
Figure 2C:
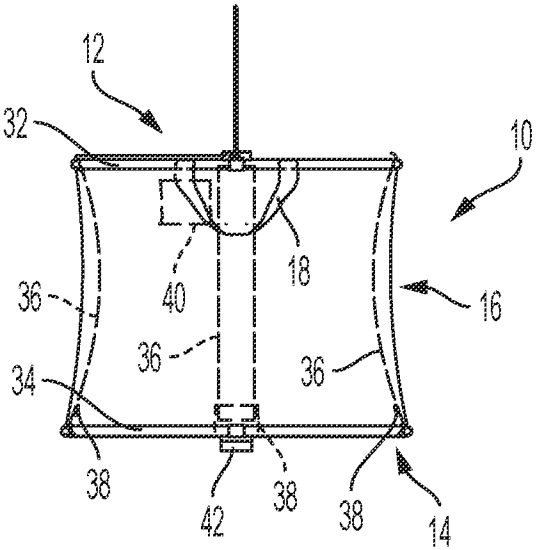
FIG. 2C depicts an orthogonal view from a side of a laundry container in the upright position with the top open according to the exemplary embodiments of the present invention depicted in FIGS. 1 and 2A-B.
Figure 2A:
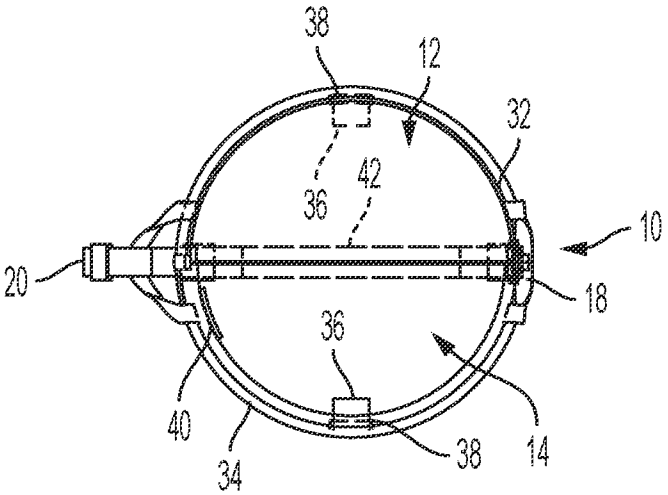
FIG. 2A depicts an orthogonal view from above of a laundry container in the upright position with the top open according to the exemplary embodiments of the present invention depicted in FIG. 1.

Referring now to FIG. 2, views of the laundry container 10 from above and from the sides are depicted in FIGS. 2A, 2B, and 2C, respectively. The laundry container 10 is depicted in the upright position with the top open. In the embodiment depicted in FIG. 2, the support structure using the sidewall stiffening panes 36 and stiffening pane pockets 38 can be seen from various angles. As depicted, the stiffening panes 36 originate at the circumferential perimeter frame 32 of the upper end wall 12, and their distal ends are inserted into the associated stiffening pane pockets 38 located adjacent to the lower end wall's 14 circumferential perimeter frame 34, providing the sidewall 16 with a standing rigidity that facilitates retaining the laundry container 10 in the upright position, as depicted.

Also visible from the various views of FIG. 2 is the laundry container's 10 open top, whereby the upper end wall 12 has been disengaged from the sidewall 16 using the fastening means 22 such that a portion of the upper end wall 12, which is preferably moveably or rotateably affixed to the sidewall 16, has been rotated up and away from the sidewall 16 to provide the user with access to the laundry container's 10 interior.

A loading handle 42 is present on the bottom surface of the lower end wall 14, which assists with loading and unloading the laundry container 10 from the laundry machines and in unloading clean laundry from the laundry container 10 upon completion of the cleaning process. The loading handle 42 is preferably made of a durable, flexible material such that the lower end wall 14 rests flat on the ground when the loading handle 42 is not in use. The preferable embodiment depicted in FIG. 2 also includes carrying handle 18, helpful for transporting the laundry container 10 over short distances, carrying strap 20, helpful for transporting the laundry container 10 over longer distances, and detergent pouch 40.

Figure 3:
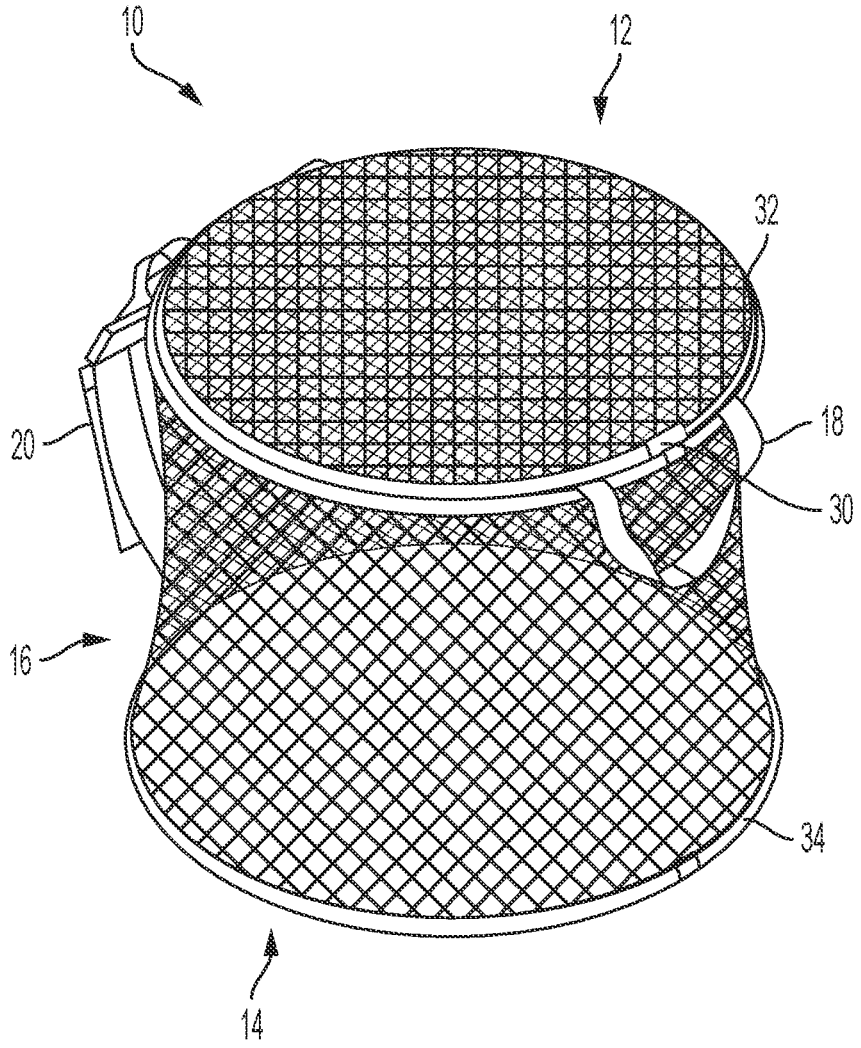
FIG. 3 depicts an isometric view of a laundry container in the upright position with the top closed according to the exemplary embodiments of the present invention depicted in FIGS. 1-2.

Referring next to FIG. 3, the laundry container 10 of the present invention is depicted in its upright position with the top closed. Here, fastening means 22 have been used to fully connect the upper end wall 12 with the sidewall 16 closing the interior of the laundry container 10 to avoid inadvertent removal of laundry items from within. In the preferable embodiment depicted in FIG. 3, slider 28 has been stowed within slider shroud 30 to prevent the slider 28 from scratching or otherwise damaging the inner drum of a machine-washer or -dryer. The laundry container 10 in the upright position with the top closed, as depicted in FIG. 3, is ideally situated for insertion into a machine-washer or -dryer. Carrying handles 18 and carrying straps 20 are present to assist the user in transporting the laundry container 10 to and from the laundry machines.

Figure 4B:
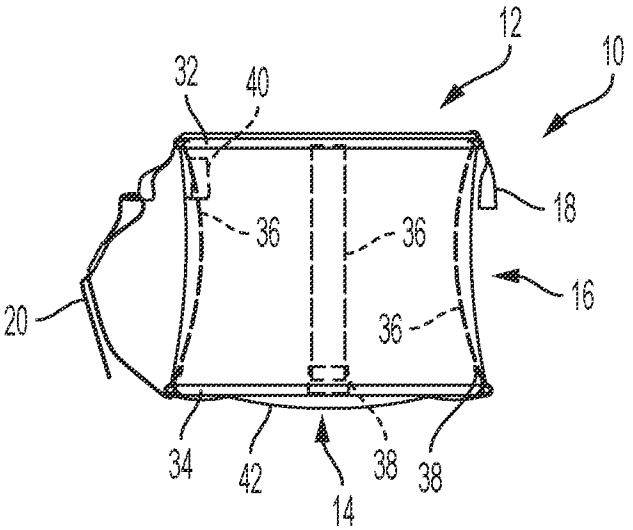
FIG. 4B depicts an orthogonal view from a side of a laundry container in the upright position with the top closed according to the exemplary embodiments of the present invention depicted in FIGS. 1-3 and 4A.
Figure 4C:
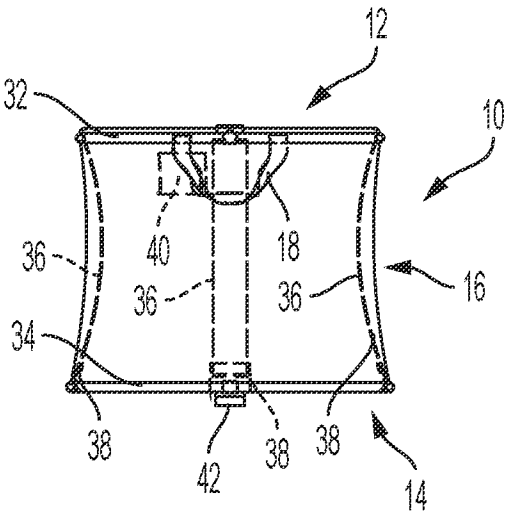
FIG. 4C depicts an orthogonal view from a side of a laundry container in the upright position with the top closed according to the exemplary embodiments of the present invention depicted in FIGS. 1-3 and 4A-B.
Figure 4A:
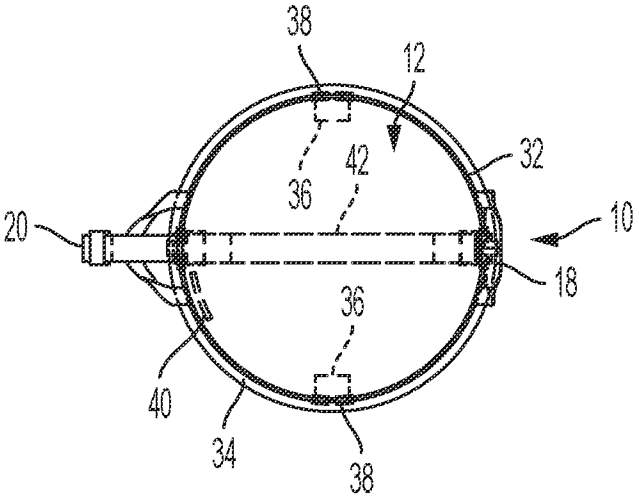
FIG. 4A depicts an orthogonal view from above of a laundry container in the upright position with the top closed according to the exemplary embodiments of the present invention depicted in FIGS. 1-3.

FIG. 4 depicts a series of views of the laundry container 10 in the upright position with the top closed. As shown again in FIG. 4, the support structure of the preferable embodiment depicted includes the stiffening panes 36 and associated stiffening pane pockets 38 assembled to retain the laundry container 10 in the upright position. In FIG. 4, the fastening means 22 are fully engaged to fully connect the upper end wall 12 to the sidewall 16. In the case of a zip fastener, the slider 28 engages the first and second rows of teeth 24, 26, located on the upper end wall 12 and sidewall 16, respectively, connecting each to the other, and the slider 28 is preferably stowed within slider shroud 30.

Figure 5:
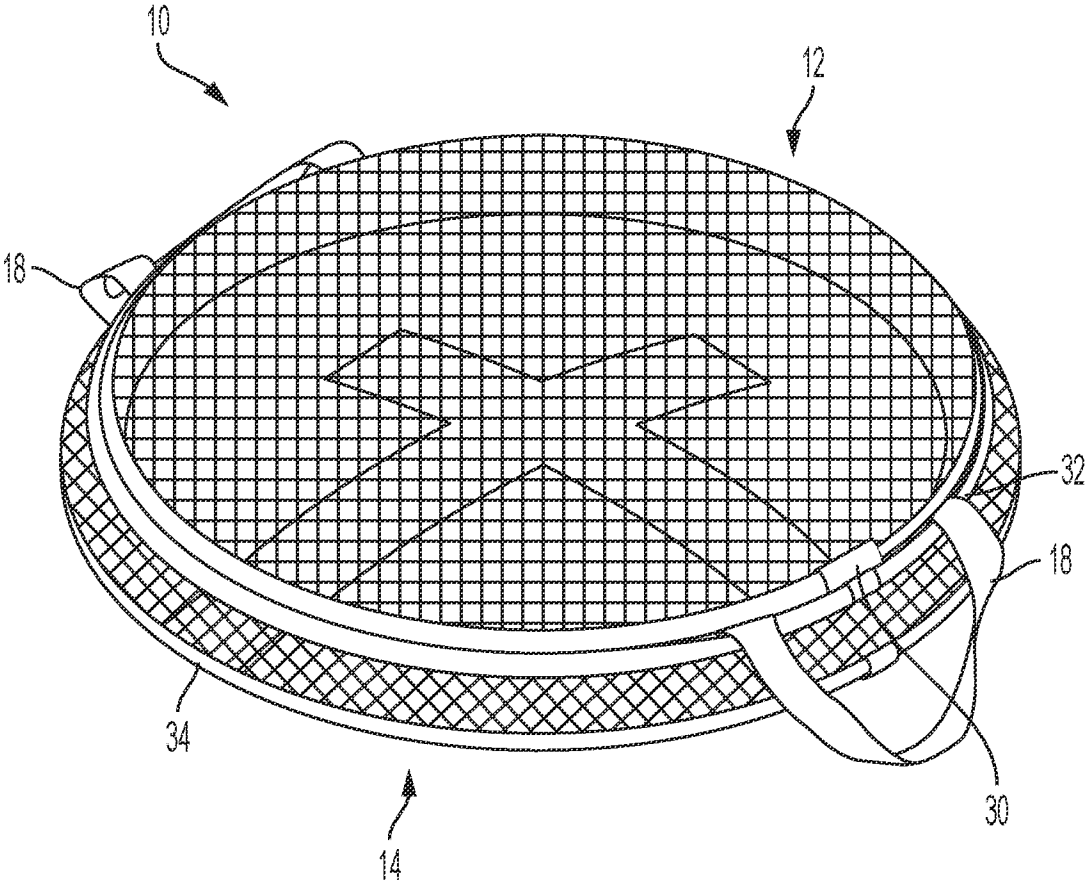
FIG. 5 depicts an isometric view of a laundry container in the collapsed state with the top closed according to the exemplary embodiments of the present invention depicted in FIGS. 1-4.

Referring next to FIG. 5, the laundry container 10 is presented in the collapsed state such that the circumferential perimeter frame 32 of the upper end wall 12 and the circumferential perimeter frame 34 of the lower end wall 14, are substantially adjacent to one another, and the sidewall 16 is bunched up therebetween. As can be seen in FIG. 5, the sidewall stiffening panes 36 have been retracted from their associated stiffening pane pockets 38, removing the sidewall's 16 standing rigidity and allowing it to collapse into the collapsed state. Preferable embodiments of the laundry container have a total height of less than about 3 inches when in the collapsed state, and more preferably of around 2 inches or less. Carrying handles 18 and carrying straps 20 are helpful for transporting the laundry container 10 in the collapsed state, which is good for transport and especially storage of the container 10.

Figure 6A:
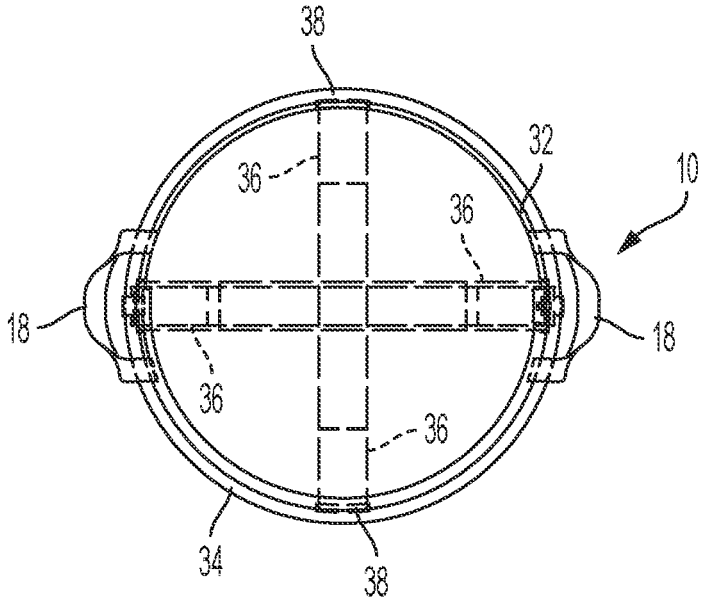
FIG. 6A depicts an orthogonal view from above of a laundry container in the collapsed state with the top closed according to the exemplary embodiments of the present invention depicted in FIGS. 1-5.
Figure 6B:
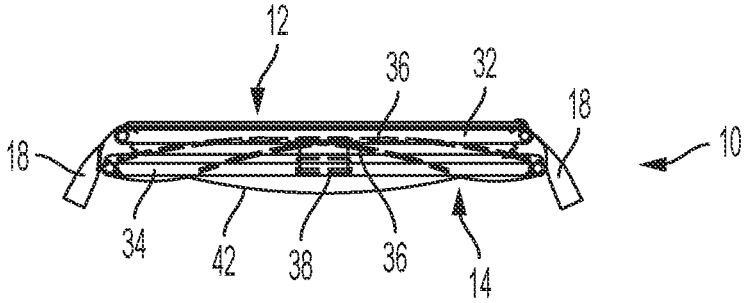
FIG. 6B depicts an orthogonal view from a side of a laundry container in the collapsed state with the top closed according to the exemplary embodiments of the present invention depicted in FIGS. 1-5 and 6A.
Figure 6C:
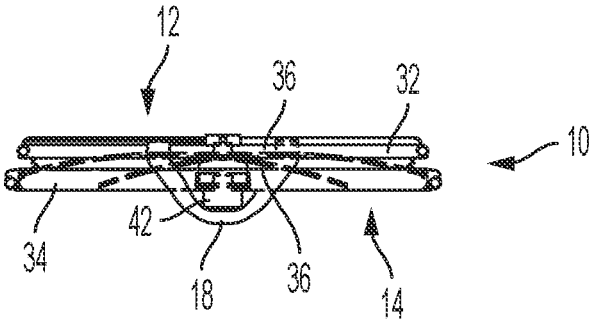
FIG. 6C depicts an orthogonal view from a side of a laundry container in the collapsed state with the top closed according to the exemplary embodiments of the present invention depicted in FIGS. 1-5 and 6A-B.
Figure 7A:
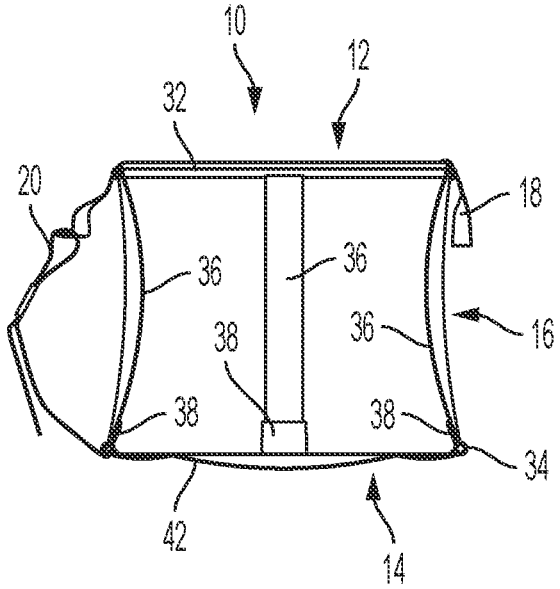
FIG. 7A depicts a cross-sectional view from a side of a laundry container in the upright position with the top closed according to the exemplary embodiments of the present invention depicted in FIGS. 1-6.
Figure 7B:
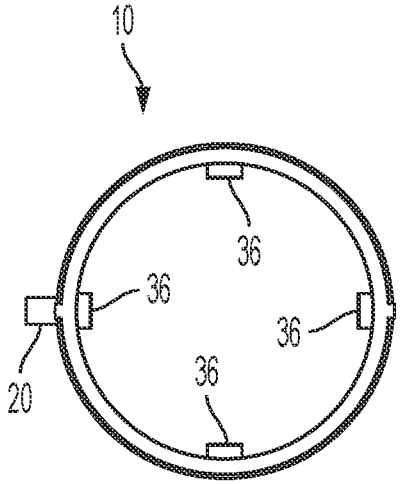
FIG. 7B depicts a cross-sectional view from above of a laundry container in the upright position with the top closed according to the exemplary embodiments of the present invention depicted in FIGS. 1-6 and 7A.
Figure 7C:
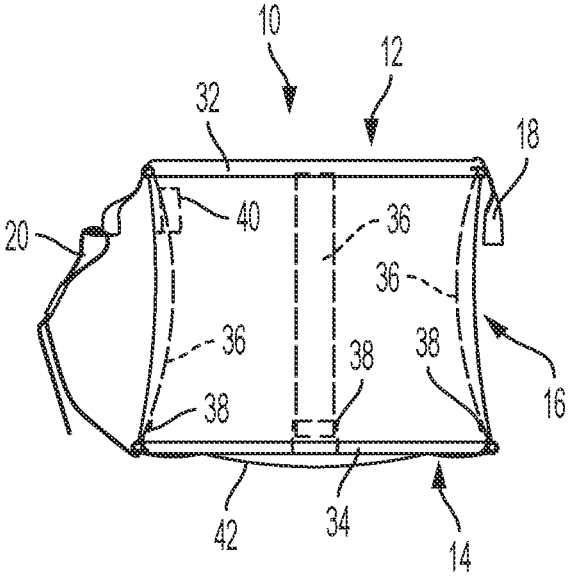
FIG. 7C depicts an orthogonal view from a side of a laundry container in the upright position with the top closed according to the exemplary embodiments of the present invention depicted in FIGS. 1-6 and 7A-B.
Figure 7D:
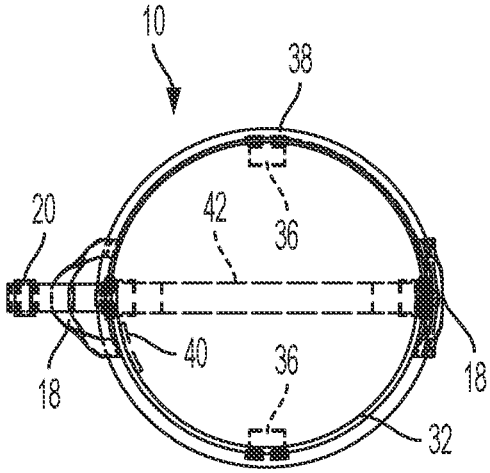
FIG. 7D depicts an orthogonal view from above of a laundry container in the upright position with the top closed according to the exemplary embodiments of the present invention depicted in FIGS. 1-6 and 7A-C.

Referring now to FIG. 6 and the various views from above and from the sides presented in FIGS. 6A, 6B, and 6C, respectively, the support structure employing the stiffening panes 36 and stiffening pane pockets 38 is particularly evident in the collapsed state. Each of the stiffening panes 36 has been removed from its associated stiffening pane pocket 38 and rests parallel to the ground and substantially flat. Because the stiffening panes 36 are rotateably connected to the circumferential perimeter frame 32, 34 of either the upper or lower end wall 12, 14, in preferable embodiments, it is easy for a user to pull the laundry container 10 back into the upright position and simply reinsert the distal ends of the stiffening panes 36 into the associated stiffening pane pockets 38, placing the laundry container back into the upright position.

Notably, some preferable embodiments may alternatively or additionally use one or more stiffening spiral ribs as a part of the laundry container's 10 support structure. Such stiffening spiral ribs preferably extend around the sidewall's 16 circumferential periphery and provide the sidewall 16 with a standing rigidity. The stiffening spiral ribs are preferably formed of a semi-rigid material that is capable of deforming in response to a compressing force but will spring back into its natural state upon release.

In preferable embodiments including one or more stiffening spiral ribs, a user can compress the laundry container 10 by applying a compressing force from substantially above and/or below, compressing the laundry container 10 into the collapsed state. Because such embodiments would spring back into the upright position upon release of the compressing force, also preferably included are means for retaining the laundry container in the collapsed state, such as a loop with snaps to encircle the upper and lower end walls' 12, 14 circumferential perimeter frames 32, 34 or the like, as will be understood by those of skill in the art.

Referring next to FIG. 7, various views are shown of the laundry container 10 in the upright position with the top closed. The use of sidewall stiffening panes 36 and stiffening pane pockets 38 is particularly visible in the cross-sectional views of FIGS. 7A and 7B, wherein four of each are providing the sidewall 16 with a standing rigidity, as discussed above.

Figure 8:
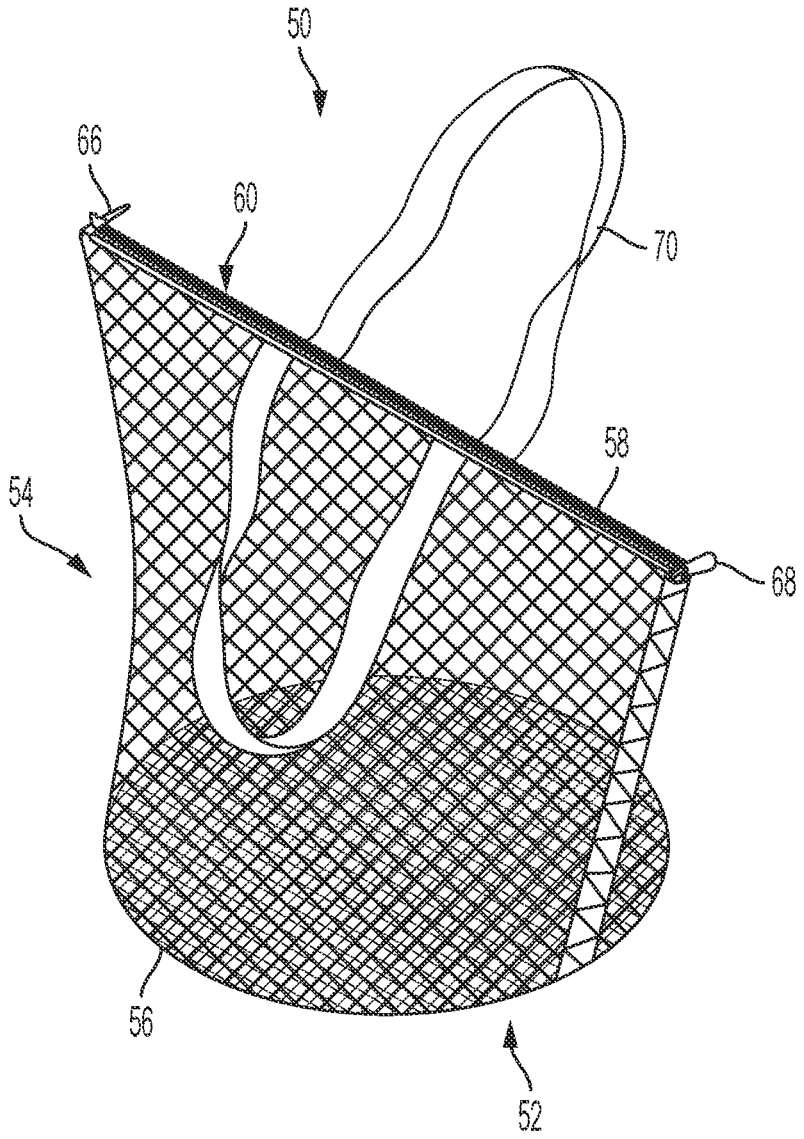
FIG. 8 depicts an isometric view of a laundry container in the upright position with the top closed according to exemplary embodiments of the present invention.

FIG. 8 depicts a preferable embodiment of a tote-style laundry container 50 according to the principles of the present invention. The tote-style container 50 includes a lower panel 52 and a collapsible upper bag portion 54 connected thereto. The upper bag portion 54 preferably connects to a circumferential perimeter frame 56 of the lower panel 52. In some preferable embodiments, the upper bag portion may have its own lower circumferential frame adjacent to the circumferential perimeter frame 56 of the lower panel 52, and the upper bag portion's 54 lower circumferential frame may be used to attach the upper bag portion 54 to the lower panel 52.

The lower panel's 52 circumferential perimeter frame 56 is preferably rigid or semi-rigid and defines the tote-style container's 50 shape, at least in part. The upper bag portion 54 preferably includes one or more substantially linear upper edge ribs 58, which are also preferably rigid or semi-rigid. The lower panel 52 and upper bag portion 54 are preferably made up of a machine-washable and -dryable, flexible, mesh material that permits the free passage of fluids for cleaning of items container therein, and the material is preferably anti-microbial, at least in part.

[ow 11] Preferable embodiments of the tote-style container 50 include a support structure including one or more supportive features, which supportive features may include the circumferential perimeter frame 56 of the lower panel 52 and the one or more substantially linear upper edge ribs 58 of the upper bag portion 54, among others. The support structure preferably operates to retain the tote-style container 50 in an upright position by giving the upper bag portion 54 standing rigidity. The support structure also preferably permits condensing the tote-style container 50 into a collapsed state by removing the upper bag portion's 54 standing rigidity.

In preferable embodiments, the supportive features include one or more sidewall stiffening panes 36 and one or more associated stiffening pane pockets 38. The stiffening panes 36 operate to bias the upper bag portion 54 outwardly and to maintain a constant distance between the circumferential perimeter frame 56 of the lower panel 52 and the upper edge ribs 58 of the upper bag portion 54, providing the upper bag portion 54 with a standing rigidity and retaining the tote-style container 50 in the upright position. The supportive features may additionally or alternatively include one or more stiffening spiral ribs extending from the circumferential perimeter frame 56 of the lower panel 52 to the one or more upper edge ribs 58 of the upper bag portion 54.

In some preferable embodiments of the tote-style container 50, the proximal end of each stiffening pane 36 is rotateably attached to an upper edge rib 58 of the upper bag portion 54, and the distal end of each stiffening pane 36 is capable of insertion into its associated stiffening pane pocket 38, located adjacent to and/or affixed to the circumferential perimeter frame 56 of the lower panel 52, or vice versa. Accordingly, the stiffening panes 36 retain the tote-style container 50 in the upright position so long as their distal ends remain inserted into their associated stiffening pane pockets 38, maintaining the standing rigidity of upper bag portion 54. When the stiffening panes 36 are released from the associated stiffening pane pockets 38, the upper bag portion 54 loses its standing rigidity (unless otherwise supported by other supportive features), and the tote-style container 50 will naturally collapse into the collapsed state.

Likewise, if a compressive force is applied from above or below, preferable embodiments of the stiffening panes 36 will deform to permit the upper edge ribs 58 of the upper bag portion 54 to reach or nearly reach the circumferential perimeter frame 56 of the lower panel 52, placing the tote-style container 50 into the collapsed state. The tote-style container 50 will naturally spring back into the upright position upon release of the compressive force so long as the stiffening panes 36 remain inserted into the associated stiffening pane pockets 38, so some preferable embodiments include fastening means to retain the tote-style container 50 in the collapsed state.

Preferable embodiments of the tote-style container 50 use a circular lower panel 52, as depicted in FIG. 8, although other shapes are also available. Such circular lower panels 52 have a diameter preferably between about 12 and 24 inches, more preferably between about 15 and 20 inches, and even more preferably of about 18.5 inches. The upper edge ribs 58 of the upper bag portion 54 have a linear length preferably between about 18 and 36 inches, more preferably between about 25 and 30 inches, and even more preferably of about 28 inches. The upper bag portion 54 has a height of between about 12 and 24 inches when fully extended (with the tote-style container 50 in the upright position), more preferably between about 15 and 20 inches, and even more preferably of about 18 inches. And when in the collapsed state, the height of the upper bag portion is preferably less than about 3 inches, and more preferably around 2 inches or less. While these sizes are preferable, those of skill in the art will recognize they are not precisely necessary to accomplish the objectives of the present invention.

The preferable embodiment of the tote-style container depicted in FIG. 8 also includes fastening means 60, which operate to open and close the tote-style container to permit loading and unloading of laundry therein. The preferable embodiments of the fastening means 60 depicted in FIG. 8 employs a zip fastener, but other equally effective fastening means 60 will be known to those of skill in the art. The zip fastener fastening means 60 preferably includes a first row of teeth 62 provided upon a substantial length of an upper edge rib 58 of the upper bag portion 54, a second row of teeth 64 provided upon a substantial length of another upper edge rib 58 of the upper bag portion 54, and a slider 66 to engage and disengage the first and second rows of teeth 62, 64. Alternatively, the zip fastener may include a first row of teeth 62 provided around a substantial portion of the circumferential perimeter frame 56 of the lower panel 52 and a second row of teeth 64 affixed around a substantial portion of a lower periphery of the edge of the upper bag portion 54 adjacent to the lower panel 52, such that the slider 66 operates to open and close the tote-style container 50 where the lower panel 52 and upper bag portion 54 meet.

Preferable embodiments of the tote-style container 50 include slider shroud 68, as depicted in FIG. 8, that is located and arranged to substantially encompass the slider 66 once the slider 66 has closed the tote-style container 50, thereby protecting the interior of laundry machines from scratching or other damage due to the slider 66. Carrying handles 70 are also preferably provided, as depicted in FIG. 8, to transport the tote-style container 50 as needed. Alternatively or in addition, one or more carrying straps may be provided as needed for longer-distance transportation.

Figure 9B:
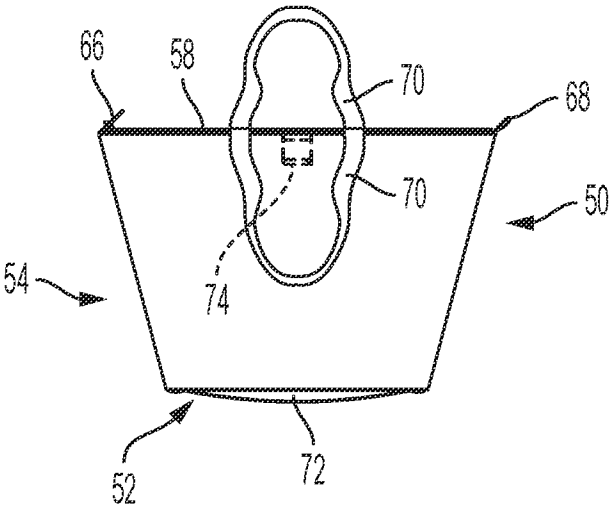
FIG. 9B depicts an orthogonal view from a side of a laundry container in the upright position with the top closed according to the exemplary embodiments of the present invention depicted in FIGS. 8 and 9A.
Figure 9C:
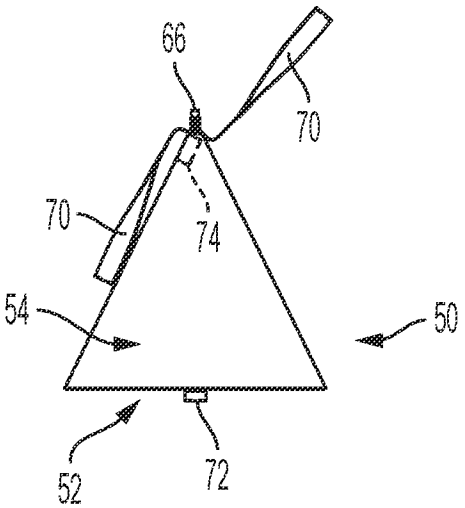
FIG. 9C depicts an orthogonal view from a side of a laundry container in the upright position with the top closed according to the exemplary embodiments of the present invention depicted in FIGS. 8 and 9A-B.
Figure 9A:
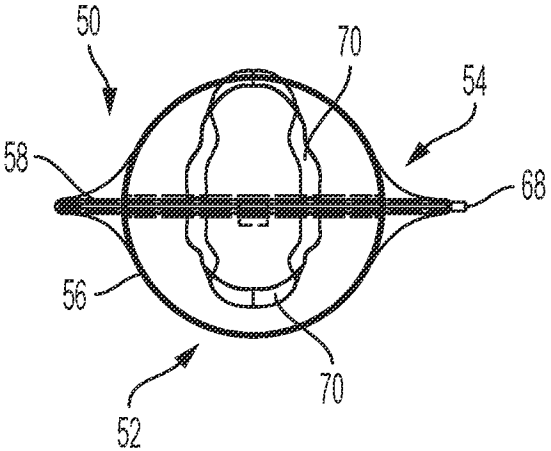
FIG. 9A depicts an orthogonal view from above of a laundry container in the upright position with the top closed according to the exemplary embodiments of the present invention depicted in FIG. 8.

Referring next to FIG. 9, the tote-style container 50 is depicted from above and from the sides, according to preferable embodiments, showing the tote-style container 50 in the upright position. Some preferable embodiments include loading handle 72 to assist in inserting and removing the tote-style container 50 from machine-washers and -dryers as well as in removing laundry items from the tote-style container 50 after cleaning. Preferable embodiments also include one or more detergent pockets 74 that are preferably located so as to be conveniently accessible whether the tote-style container 50 is inside or outside of a machine-washer. A coin pouch may also be provided in some preferable embodiments of the tote-style container 50.

One or more magnets are preferably included among one or both of the tote-style container's 50 lower panel 52 and upper bag portion 54, which are preferably useable to attach the tote-style container 50 to the inner drum of a machine-washer and -dryer to ensure it is adequately agitated to properly clean the laundry within. Preferable embodiments of the tote-style container 50 further include a central bore extending from a central portion of the lower panel 52 into the interior of the tote-style container 50. The central bore is intended to accommodate the vertical protrusion in some machine-washers and allows the tote-style container 50 to be successfully installed therein by inserting the vertical protrusion into the central bore. The central bore preferably is able to be rolled up and stowed away when not in use to avoid interference with the other operations of the tote-style container 50, and preferable embodiments include a bore pouch with fastening means to retain the central bore therein.

Figure 10:
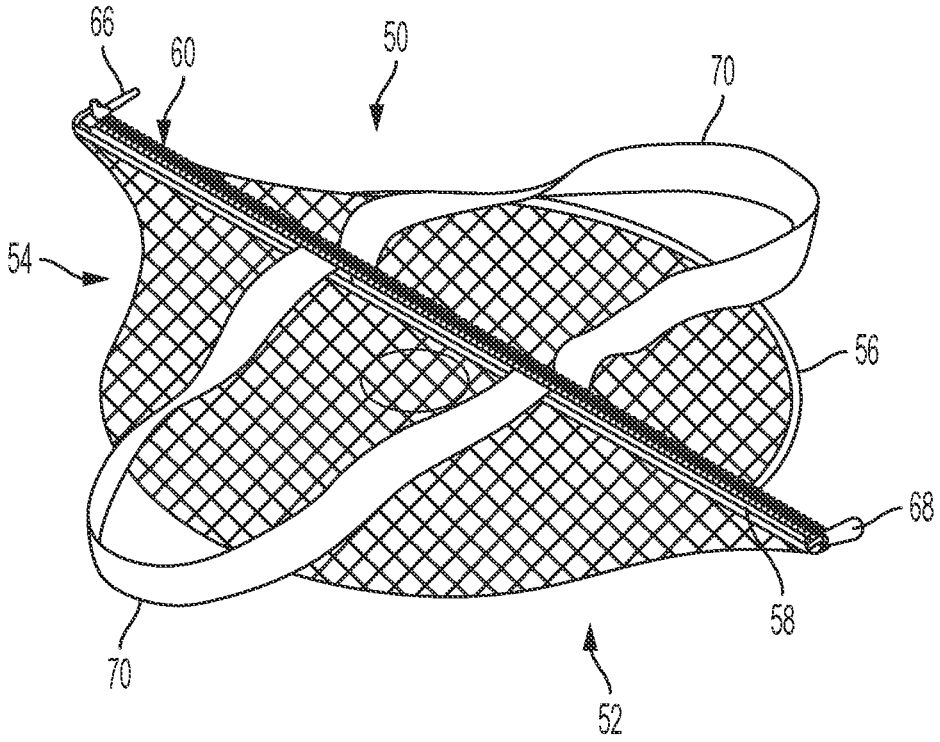
FIG. 10 depicts an isometric view of a laundry container in the collapsed state with the top closed according to the exemplary embodiments of the present invention depicted in FIGS. 8-9.
Figure 11A:
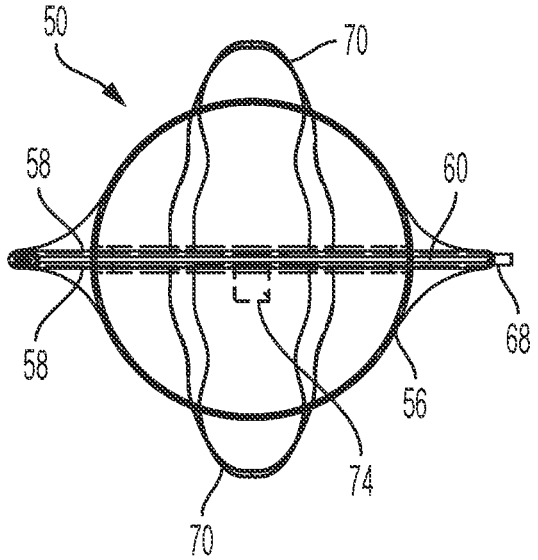
FIG. 11A depicts an orthogonal view from above of a laundry container in the collapsed state with the top closed according to the exemplary embodiments of the present invention depicted in FIGS. 8-10.
Figure 11B:
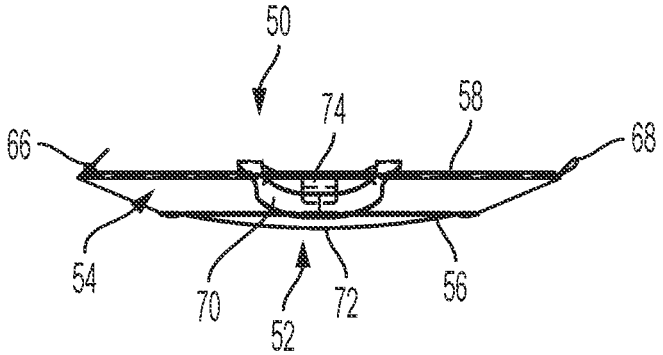
FIG. 11B depicts an orthogonal view from a side of a laundry container in the collapsed state with the top closed according to the exemplary embodiments of the present invention depicted in FIGS. 8-10 and 11A.
Figure 11C:
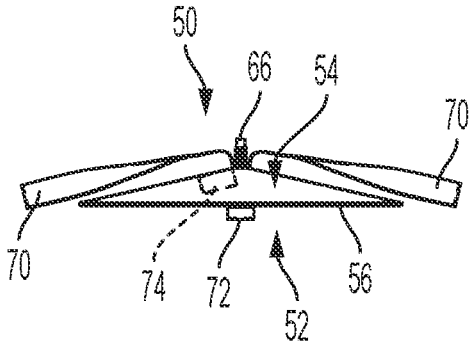
FIG. 11C depicts an orthogonal view from a side of a laundry container in the collapsed state with the top closed according to the exemplary embodiments of the present invention depicted in FIGS. 8-10 and 11A-B.

Referring now to FIG. 10, the tote-style container 50 is depicted in the collapsed state, with the upper edge rib 58 of the upper bag portion 54 substantially adjacent to the lower panel 52. FIG. 11 shows various view from above and from the sides of the tote-style container in the same collapsed state, which is created either by removing the stiffening panes 36 from the associated stiffening pane pockets 38, in some preferable embodiments, and/or by compressing the tote-style container 50 into the collapsed state.

Figure 12:
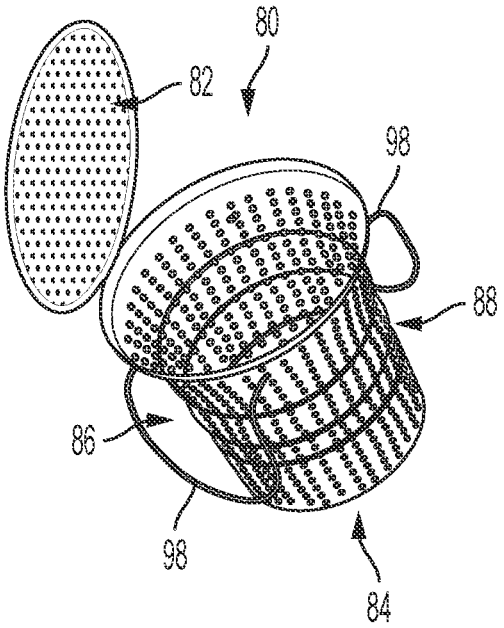
FIG. 12 depicts a perspective view of a laundry container in the upright position with the top open according to exemplary embodiments of the present invention.
Figure 13:
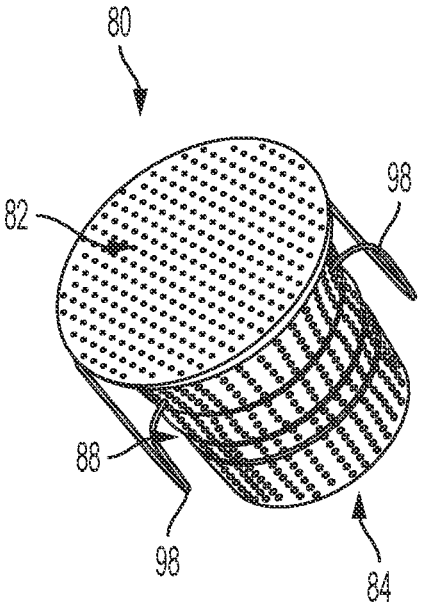
FIG. 13 depicts a perspective view of a laundry container in the upright position with the top closed according to the exemplary embodiments of the present invention depicted in FIG. 12.

Referring next to FIG. 12, laundry container 80 is depicted in the upright position with the top open. FIG. 13 depicts the laundry container 80 with the top closed. The preferable embodiment of the laundry container 80 depicted in FIGS. 12-14 includes an upper end wall 82, a lower end wall 84, and a sidewall extending therebetween. The upper end wall 82 is preferably moveably or rotateably connected to the sidewall 86, as depicted in FIG. 12. Each of the upper and lower end walls 82, 84 and the sidewall 86 are made of a machine-washable and -dryable mesh material that permits fluids, including soap and water, to freely pass in and out of the container 80. The sidewall 86 specifically, and the upper and lower end walls 82, 84 in some embodiments, is made of a self-supporting, semi-rigid but deformable, silicon or similar material. The sidewall 86 is thus provided with a natural standing rigidity, by which the laundry container 80 maintains an upright position but may be compressed into a collapsed state by compressing forces from substantially above and/or below. The upper and lower end walls 82, 84 and the sidewall 86 are also anti-microbial, at least in part, in preferable embodiments.

Preferable embodiments of the laundry container 80 employ circular upper and lower end walls 82, 84 and an accordingly substantially cylindrical sidewall 86. In such preferable embodiments, the upper end wall 82 has a diameter preferably between about 18 and 36 inches, more preferably between about 25 and 30 inches, and even more preferably of around 27 inches. The lower end wall 84 has a diameter preferably between about 12 and 24 inches, more preferably between about 15 and 20 inches, and even more preferably around 18 inches. The sidewall 86 has a fully extended length preferably between about 18 and 36 inches, more preferably between about 20 and 25 inches, and even more preferably around 24 inches. The sidewall's 86 length is preferably less than about 5 inches, and more preferably around 3 inches or less, when the sidewall 86 is fully compressed in the collapsed state.

The sidewall 86 preferably includes one or more undulations 88 that facilitate compressing the laundry container 80 into the collapsed state. The one or more undulations 88, in cylindrical embodiments of the sidewall 86, have a cross-sectional diameter preferably between about 15 and 30 inches depending upon their location along the length of the sidewall 86. Those of skill in the art will understand the advantageous arrangements and sizes of the undulations 88 available to the present invention.

Figure 14:
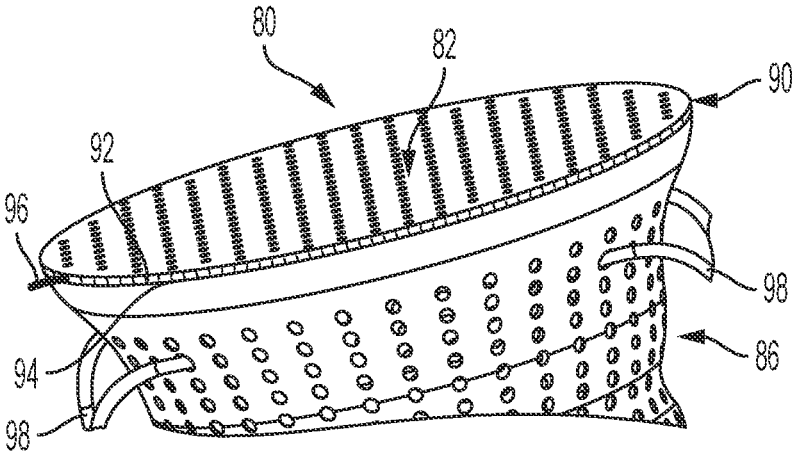
FIG. 14 depicts an enlarged perspective view of a laundry container in the upright position with the top closed according to the exemplary embodiments of the present invention depicted in FIGS. 12-13.

Preferable embodiments of the laundry container 80 include fastening means 90 for engaging and disengaging the upper end wall 82 from the sidewall 86, as particularly visible in FIG. 14's enlarged view. The fastening means 90 may include any form of effective fastener, as will be understood by those of skill in the art, but preferably include a zip fastener with a first row of teeth 92 provided along a substantial portion of the circumferential perimeter of the upper end wall 82, a second row of teeth 94 provided along a substantial portion of the upper edge periphery of the sidewall 86 adjacent to the upper end wall 82, and a slider 96 operable to engage and disengage the first and second rows of teeth 92, 94. Alternatively, the first and second rows of teeth 92, 94 may be provided across a central diameter of the upper end wall 82, such that the slider 96 operates to open and close the top of the laundry container 80 from the center of the upper end wall 82. Some preferable embodiments include a slider shroud to encompass the slider 96 when the laundry container 80 is fully closed so as to protect the inside of machine-washers and -dryers from scratching and other damage.

Figure 15A:
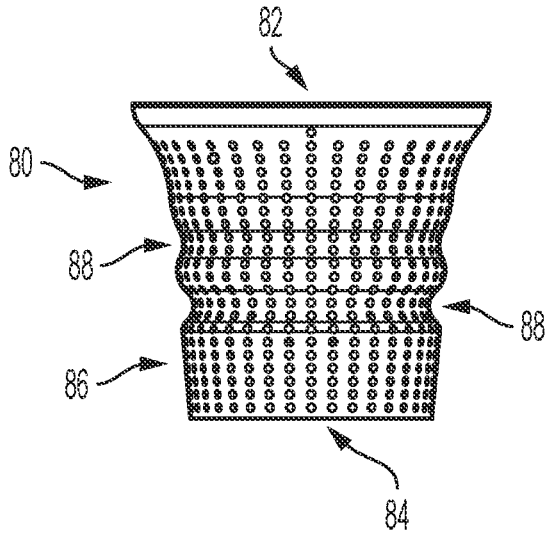
FIG. 15A depicts an orthogonal view from a side of a laundry container in the upright position with the top closed according to the exemplary embodiments of the present invention depicted in FIGS. 12-14.
Figure 15B:
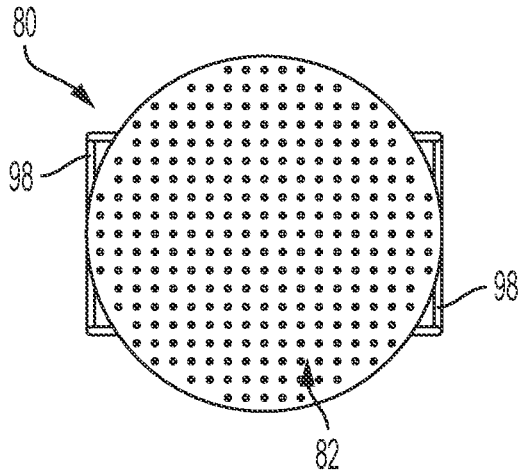
FIG. 15B depicts an orthogonal view from above of a laundry container in the upright position with the top closed according to the exemplary embodiments of the present invention depicted in FIGS. 12-14 and 15A.
Figure 15C:
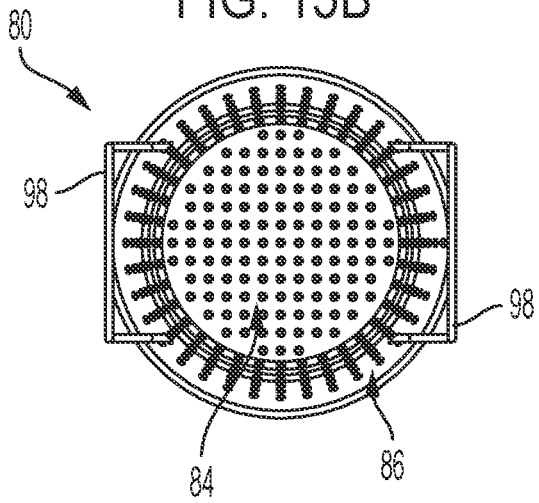
FIG. 15C depicts a cross-sectional view from above of a laundry container in the upright position according to the exemplary embodiments of the present invention depicted in FIGS. 12-14 and 15A-B.

One or more transport handles 98 may be provided in some preferable embodiments of the laundry container 80, as well as one or more carrying straps and one or more loading handles. One or more detergent pockets and coin pouches are also preferably included, and the laundry container 80 also preferably includes one or more magnets arranged among one or more of the upper end wall 82, the lower end wall 84, and the sidewall 86 to help connect the laundry container 80 to the inner drum of a machine-washer and -dryer. FIG. 15 shows several views of the laundry container 80 from the side and from above depicting various of these and other preferable features.

Some preferable embodiments of the laundry container 80 also include a central bore that extends from either the upper end wall 82 or the lower end wall 84 and into the interior of the laundry container 80. The central bore is sized and oriented to surround a vertical protrusion present in some machine-washers. The central bore is preferably comprised of the same semi-rigid, self-supporting, silicon or other similar material as that of the sidewall 86 such that it may maintain an extended or compressed state according to the user's needs.

Figure 16:
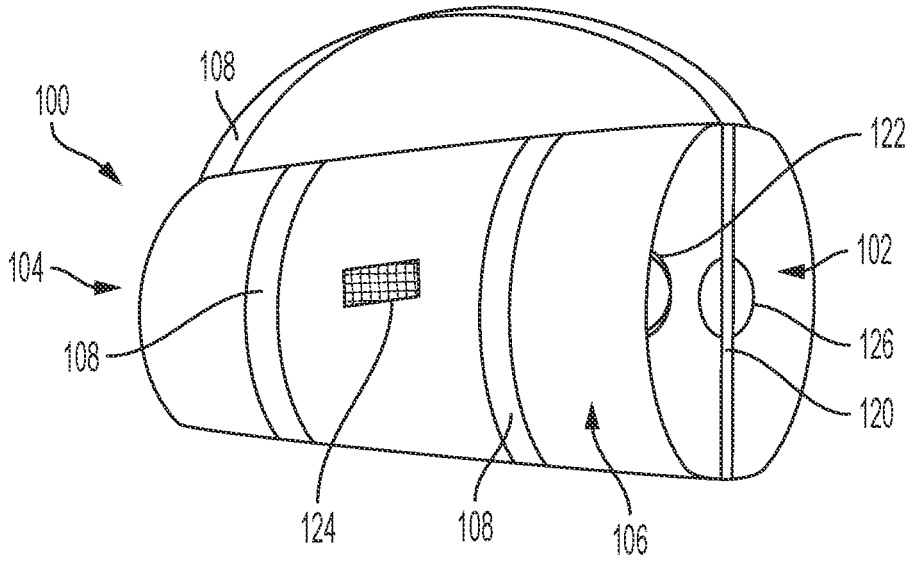
FIG. 16 depicts a perspective view of a laundry container in the upright position with the top closed according to exemplary embodiments of the present invention.

Referring next to FIG. 16, a laundry container 100 according to preferable embodiments of the present invention is depicted, the laundry container 100 including an upper end wall 102, a lower end wall 104 and a sidewall 106 extending therebetween. The laundry container 100 preferably includes one or more carrying straps 108, preferably extending perpendicular or parallel to the length of the sidewall 106, as depicted, although other angles and arrangements are likewise recommendable. Lengthwise carrying straps 108 may encourage carrying the laundry container 100 similar to a duffel bag, and widthwise carrying straps 108 may encourage carrying the container 100 similar to a backpack. The upper and lower end walls 102, 104 and sidewall 106 are preferably made of a machine-washable and -dryable, flexible, mesh material that is anti-microbial, at least in part.

Preferable embodiments of the laundry container 100 include a support structure including one or more supportive features that operate to provide the laundry container 100 with a standing rigidity and retain it in an upright position while also allowing the laundry container 100 to be condensed into a collapsed state. As depicted in FIG. 18, and particularly in FIGS. 18A and 18B, the laundry container 100 also preferably includes fastening means 110 that operate to open and close the top of the laundry container 100 and permit or deny access to its interior. Preferable embodiments of the fastening means 110 employ a zip fastener, as depicted in FIGS. 18A and 18B.

Figure 18A:
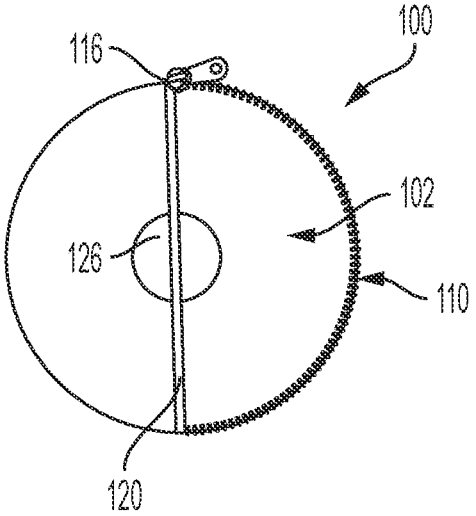
FIG. 18A depicts an orthogonal view from above of a laundry container in the upright position with the top closed according to the exemplary embodiments of the present invention depicted in FIGS. 16-17.
Figure 18B:
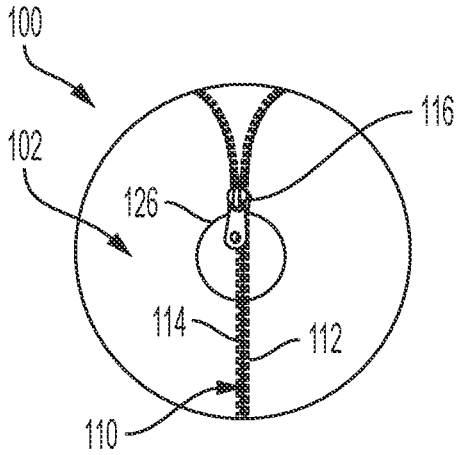
FIG. 18B depicts an orthogonal view from above of a laundry container in the upright position with the top partially open according to the exemplary embodiments of the present invention depicted in FIGS. 16-17 and 18A.
Figure 18C:
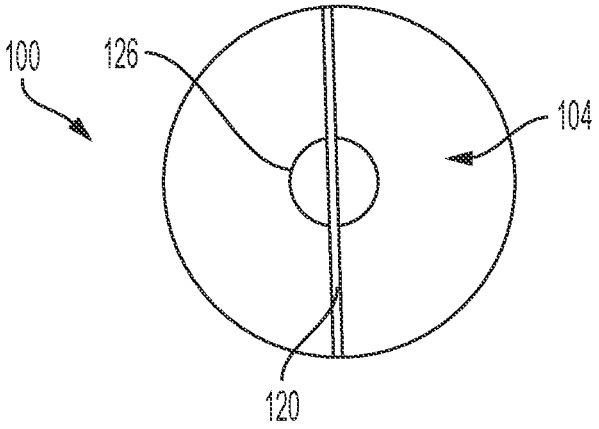
FIG. 18C depicts an orthogonal view from below of a laundry container in the upright position according to the exemplary embodiments of the present invention depicted in FIGS. 16-17 and 18A-B.

The zip fastener preferably includes a first row of teeth 112 on at least a portion of the upper end wall 102, a second row of teeth 114 on at least a substantial portion of the upper edge periphery of the sidewall 106 adjacent to the upper end wall 102, and a slider 116 operable to engage and disengage the first and second rows of teeth 112, 114, as depicted in FIG. 18A. Alternatively, the first and second rows of teeth 112, 114 may extend along a substantially central diameter of the upper end wall 102 such that the laundry container opens from the top center, as depicted in FIG. 18B. In each case, a slider shroud is preferably provided to prevent the slider 116 from scratching or otherwise damaging the interior of a machine-washer or -dryer.

Figure 17:
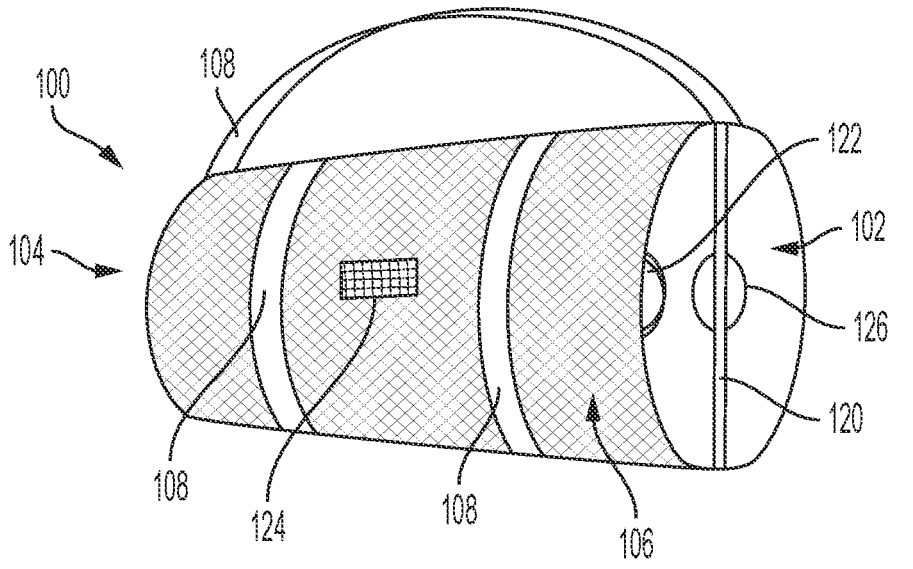
FIG. 17 depicts a perspective view of a laundry container in the upright position with the top closed according to the exemplary embodiments of the present invention depicted in FIG. 16.

As depicted in FIGS. 16-18, preferable embodiments of the laundry container 100 include one or more loading handles 120 provided on the upper or lower end wall 102, 104 or both. One or more detergent pockets 122 and/or coin pouches are also preferably included. And the laundry container 100 preferably includes one or more magnets 124 arranged among the upper and lower end walls 102, 104 and the sidewall 106 to assist with the cleaning process by ensuring the laundry container 100 is properly agitated along with the inner drum of the machine-washer and -dryer and stays spread out substantially within the machine-washer and -dryer during use.

Preferable embodiments of the laundry container 100 include a central bore 126 that preferably extends from one or both of the upper and lower end walls 102, 104 and into the interior of the laundry container to accommodate the vertical protrusion present within some machine-washers, as depicted in FIGS. 16-19. The central bore 126 is preferably made of the same machine-washable and dryable, flexible, mesh material as the upper and lower end walls 102, 104 and sidewall 106. The laundry container 100 also preferably includes a bore pouch for storing the central bore 126 when not needed.

Figure 19:
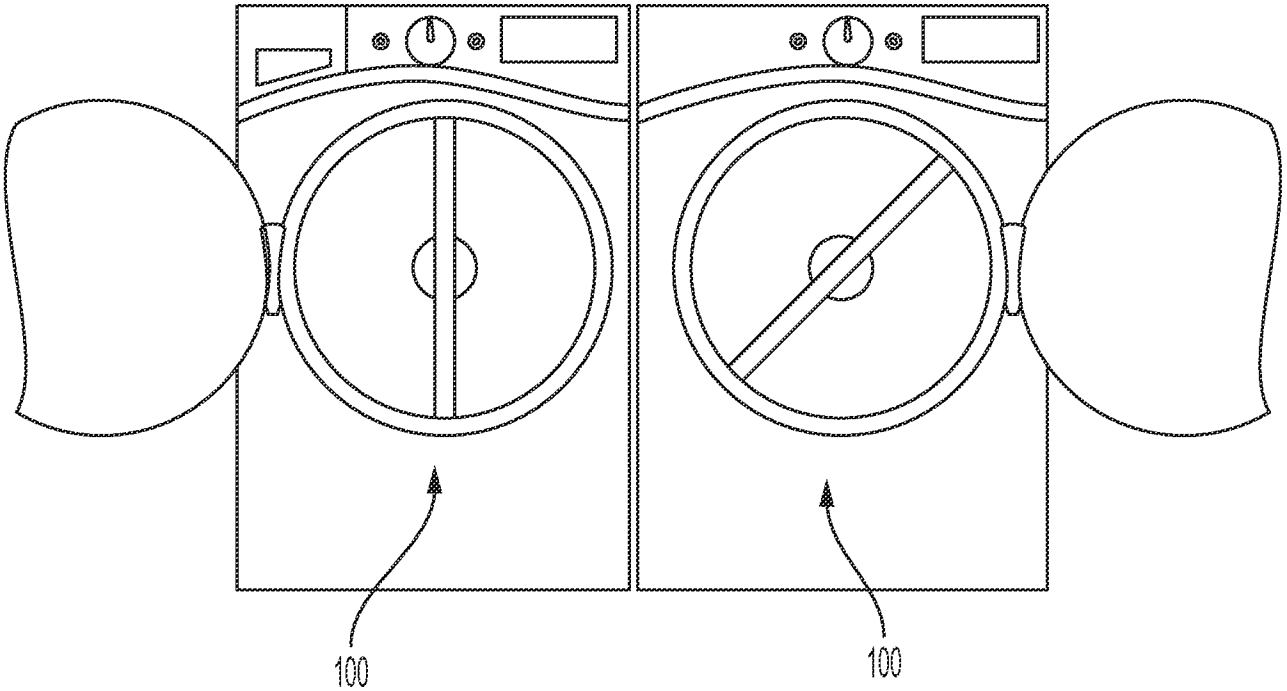
FIG. 19 depicts a perspective view of laundry containers inserted into a machine-washer and a machine-dryer according to exemplary embodiments of the present invention.

Referring now to FIG. 19, the laundry container 100 according to the present invention is depicted installed in a machine-washer and -dryer and undergoing the cleaning process. Laundry is present within, accomplishing the present invention's primary objective of providing a laundry container 100 that is capable of operating as a standing hamper or tote that can be loaded into a machine-washer and/or -dryer to clean dirty laundry held within without any user-interaction with the laundry items beforehand.

While the present invention has been described with reference to particular embodiments and arrangements of parts, features, and the like, it is not limited to these embodiments or arrangements. Indeed, modifications and variations will be ascertainable to those of skill in the art, all of which are inferentially and inherently included in these teachings.

What is claimed is:

1. A container for laundry, comprising:

an upper end wall and a lower end wall with a sidewall extending therebetween, each of the upper end wall, the lower end wall, and the sidewall comprising a machine washable and dryable, vinyl-coated, flexible mesh material that allows the passage of fluids therethrough;

a fastener engageable to fully connect the upper end wall with the sidewall to prevent access to clothing items within the container when in a closed state and to permit access to clothing items within the container when in an open state;

the sidewall comprising one or more supports for retaining the container in an upright position, the supports also permitting the container to be collapsed into a collapsed state; and a central bore sized and oriented to encompass a vertical protrusion in a central interior of a machine-washer and being extendable into an interior of the container when encompassing the vertical protrusion and otherwise collapsible to prevent interference with clothing items within the container, the central bore comprising a machine washable and dryable, flexible mesh material that allows the passage of fluids therethrough and further comprising a bore pouch for containing the central bore when the central bore is not encompassing the vertical protrusion, the bore pouch comprising a zip fastener;

wherein the container operates as a standing hamper when in the upright position and the open state, is sized and shaped to be placed within an interior of a standard-sized machine-washer and within an interior of a standard sized machine-dryer when in the upright position, and may be collapsed into the collapsed state for easy transport and storage, facilitating the container's use as an all-in-one laundry hamper and machine-washable laundry bag.

2. The container for laundry as claimed in claim 1, wherein the one or more supports of the sidewall comprise one or more stiffening panes and one or more pockets, the one or more stiffening panes retaining the container in the upright position by providing the sidewall with a standing rigidity when tucked within the one or more pockets and permitting the sidewall to collapse into the collapsed state when removed from the one or more pockets.

3. The container for laundry as claimed in claim 1, wherein the one or more supports of the sidewall comprise one or more spiral ribs retaining the container in the upright position by providing the sidewall with a standing rigidity and permitting the sidewall to collapse into the collapsed state when subjected to a compressing force directed substantially parallel to a length of the sidewall.

4. The container for laundry as claimed in claim 1, wherein the fastener comprises a zip fastener comprising a first row of teeth affixed around a substantial portion of a periphery of the upper end wall, a second row of teeth affixed around a substantial portion of the periphery of an edge of the sidewall adjacent to the upper end wall, and a slider.

5. The container for laundry as claimed in claim 4, further comprising a shroud for the slider of the zip fastener, the shroud being located to substantially encompass the slider when the container is in the closed state.

6. The container for laundry as claimed in claim 1, wherein the upper end wall and the lower end wall are circular in shape and the sidewall is cylindrical in shape.

7. The container for laundry as claimed in claim 6, wherein the upper end wall has a diameter of about 16 inches, the lower end wall has a diameter of about 17 inches, and the sidewall has a length of about 13 inches when fully extended in the upright position.

8. The container for laundry as claimed in claim 1, wherein the upper end wall is moveably affixed to the sidewall.

9. The container for laundry as claimed in claim 1, wherein the sidewall further comprises two or more straps arranged substantially perpendicular to a length of the sidewall to facilitate holding and transporting the container.

10. The container for laundry as claimed in claim 1, wherein the sidewall further comprises one or more straps arranged substantially parallel to a length of the sidewall to facilitate holding and transporting the container.

11. The container for laundry as claimed in claim 1, wherein the lower end wall further comprises one or more handles to facilitate inserting and removing the container into and from a machine-washer and machine-dryer.

12. The container for laundry as claimed in claim 1, further comprising one or more magnets arranged among one or more of the upper end wall, lower end wall, and sidewall to removably attach the container to the interior of a machine-washer and machine-dryer.

13. The container for laundry as claimed in claim 1, further comprising a detergent pouch for holding and releasing cleaning products when the container is in use in a machine-washer.

14. The container for laundry as claimed in claim 1, further comprising a laundry-item pocket for holding personal effects.

* * * * *